US009759477B2

(12) United States Patent
Lee et al.

(10) Patent No.: US 9,759,477 B2
(45) Date of Patent: Sep. 12, 2017

(54) REFRIGERATOR

(71) Applicant: LG ELECTRONICS INC., Seoul (KR)

(72) Inventors: Jihyun Lee, Seoul (KR); Jinwon Kang, Seoul (KR); Hangbok Lee, Seoul (KR); Kyutae Park, Seoul (KR); Woonkyu Seo, Seoul (KR); Daesung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/334,080

(22) Filed: Oct. 25, 2016

(65) Prior Publication Data

US 2017/0038126 A1 Feb. 9, 2017

Related U.S. Application Data

(63) Continuation of application No. 14/580,277, filed on Dec. 23, 2014, now Pat. No. 9,518,777.

(30) Foreign Application Priority Data

Dec. 23, 2013 (KR) ..... 10-2013-0160908
Dec. 23, 2013 (KR) ..... 10-2013-0161508

(51) Int. Cl.
*F25D 23/02* (2006.01)
*E05B 65/00* (2006.01)
(Continued)

(52) U.S. Cl.
CPC ..... *F25D 23/028* (2013.01); *E05B 65/0042* (2013.01); *E05C 7/02* (2013.01);
(Continued)

(58) Field of Classification Search
CPC ..... F25D 23/04; F25D 23/025; F25D 23/028; F25D 23/00; E05B 65/0042; E05C 7/02; E05C 19/10
(Continued)

(56) References Cited

U.S. PATENT DOCUMENTS 2,122,680 A 7/1938 Dart
2,124,349 A 7/1938 Herbster
(Continued)

FOREIGN PATENT DOCUMENTS

CN 102695933 9/2012
CN 102947657 2/2013
(Continued)

OTHER PUBLICATIONS

Search Report dated May 4, 2015 from related European Patent Application No. 14197344.6, 6 pages.
(Continued)

*Primary Examiner* — James O Hansen
(74) *Attorney, Agent, or Firm* — Fish & Richardson P.C.

(57) ABSTRACT

A refrigerator includes a cabinet that defines a first storage compartment configured to store food, a main door rotatably mounted on the cabinet and configured to open or close at least a portion of the first storage compartment, an accommodation device accessible through an opening in the main door, a sub door mounted on the main door and configured to open or close the opening, and a door opening assembly that is configured to selectively restrict one side of a back surface of the sub door to a corresponding side of a front surface of the main door to thereby selectively restrict movement of the sub door relative to the main door. The accommodation device defines a second storage compartment within the main door that is separated from the first storage compartment, and the door opening assembly is
(Continued)

configured to be manipulated from a side surface of the sub door.

12 Claims, 21 Drawing Sheets

(51) Int. Cl.
*F25D 23/00* (2006.01)
*F25D 23/04* (2006.01)
*E05C 7/02* (2006.01)
*E05C 19/10* (2006.01)

(52) U.S. Cl.
CPC ..... *E05C 19/10* (2013.01); *F25D 23/00* (2013.01); *F25D 23/025* (2013.01); *F25D 23/04* (2013.01); *F25D 2323/023* (2013.01)

(58) Field of Classification Search
USPC ..... 312/401, 405, 405.1, 291, 292, 319.9; 62/440, 449
See application file for complete search history.

(56) References Cited

U.S. PATENT DOCUMENTS

| | | | | |
|---|---|---|---|---|
| 2,129,923 | A | | 9/1938 | Frankel |
| 2,130,617 | A | | 9/1938 | Dockham |
| 2,131,680 | A | | 9/1938 | Zahodiakin |
| 2,150,064 | A | | 3/1939 | John |
| 2,348,955 | A | * | 5/1944 | Buchanan ..... E05B 65/0042 292/255 |
| 2,942,438 | A | | 6/1960 | Schmeling |
| 3,086,830 | A | | 4/1963 | Malia |
| 3,364,621 | A | | 1/1968 | Erickson |
| 5,538,338 | A | | 7/1996 | Biggers |
| 2013/0033163 | A1 | | 2/2013 | Kang |
| 2013/0169139 | A1 | | 7/2013 | Jung |

FOREIGN PATENT DOCUMENTS

| | | |
|---|---|---|
| CN | 102967107 | 3/2013 |
| DE | 3139164 | 4/1982 |
| EP | 2565565 | 7/2014 |
| JP | 48056657 | 8/1973 |
| JP | 50084862 | 7/1975 |
| JP | 61058486 | 12/1986 |
| WO | 2011162525 | 5/2012 |

OTHER PUBLICATIONS

Office Action issued in Chinse Application No. 201410815490.0 on Aug. 3, 2016, 30 pages. (with English translation).

* cited by examiner

REFRIGERATOR

CROSS-REFERENCE TO RELATED APPLICATIONS

This application is a continuation of U.S. application Ser. No. 14/580,277, filed on Dec. 23, 2014, now U.S. Pat. No. 9,518,777, which claims priority from and the benefit of Korean patent application nos. 10-2013-0161508, filed on Dec. 23, 2013, and 10-2013-0160908, filed on Dec. 23, 2013, all of which are hereby incorporated by reference in their entirety.

TECHNICAL FIELD

The present disclosure relates to a refrigerator.

BACKGROUND

In general, refrigerators are home appliances for storing foods at a low temperature in a storage space thereof that is covered by a door. For this, refrigerators can cool the inside of the storage space by using cool air generated by being heat-exchanged with a refrigerant circulated into a refrigeration cycle to store foods in an optimum state.

In recent years, refrigerators have tended to increase in size, and multi-functions have been applied to refrigerators as dietary life changes and high-quality are pursued. Accordingly, refrigerators of various structures with consideration of user convenience and energy efficiency are being brought to the market. For example, a refrigerator may include a separate storage space that is defined in a door, and a home bar door for opening or closing the separate storage space is provided to store foods in the storage space.

SUMMARY

According to one aspect, a refrigerator includes a cabinet defining a first storage compartment that is configured to store food, a main door rotatably mounted on the cabinet and configured to open or close at least a portion of the first storage compartment, an accommodation device that is accessible through an opening in the main door, where the accommodation device defines a second storage compartment within the main door that is separated from the first storage compartment, a sub door mounted on the main door and configured to open or close the opening, and a door opening assembly that is configured to selectively restrict one side of a back surface of the sub door to a corresponding side of a front surface of the main door to thereby selectively restrict movement of the sub door relative to the main door, where the door opening assembly is configured to be manipulated from a side surface of the sub door.

Implementations of this aspect may include one or more of the following features. For example, the main door may include a locking unit that is configured to become selectively restricted with one side of the door opening assembly. The locking unit may include a latch cam configured to rotate to be selectively coupled to the one side of the door opening assembly, and an opening rod that is accessible through a front surface of the main door, wherein the opening rod is configured to be pushed to release the restriction between the latch cam and the door opening assembly. The door opening assembly may include a locking member protruding from the back surface of the sub door, where the locking member is configured to couple to the locking unit, a manipulation member disposed at a side surface of the sub door, a push rod mounted within the sub door at a position corresponding to the opening rod, the push rod being configured to move backward to push the opening rod, and a connection member within the sub door that couples the manipulation member to the push rod such that moving the manipulation member moves the push rod. An elastic member may be disposed on each of the opening rod and the push rod to allow each of the opening rod and the push rod to return to its original position after being moved from the original position. An upper end of the connection member has a slope and is configured to contact an end of the push rod. The push rod may be disposed inside the sub door and pass through a rod case, where an elastic member that is located within the rod case is compressed when the push rod moves from its original position. The end of the push rod that contacts the sloped upper end of the connection member may include a contact part having a rounded shape.

Also according to this aspect, the manipulation member may include a body configured to receive and rotate about a rotation shaft that is mounted inside the sub door, a push part disposed on a lower end of the body, where the push part protrudes outward from the sub door and being configured to be pushed by a user, and an operational part disposed on an upper end of the body to contact a lower end of the connection member. An upper end of the operational part and the lower end of the connection member may have slopes opposite to each other and may be configured to maintain contact with each other during use. The door opening assembly may include a locking member protruding from the back surface of the sub door and configured to be selectively restricted to the main door, a manipulation member disposed at a side surface of the sub door, the manipulation member being configured to be manipulated by a user, and a connection member disposed within the sub door that couples the locking member to the manipulation member, where the connection member is interlocked with the manipulation member such that manipulating the manipulation member releases a restriction between the locking member and the main door. The locking member may be rotatably mounted to the sub door and configured to rotate to be selectively restricted with a hook part of the main door. The manipulation member may include a rotational part rotatably mounted inside the sub door, a push part disposed on the rotational part and exposed to an outer end of the door, the push part being configured to be pushed by the user, and a support part extending from one side of the rotational part and shaft-coupled to the connection member, where the support part supports the connection member to allow vertical movement of the connection member. A guide member may be mounted inside the sub door and include latch mounting part on which the locking member is rotatably mounted, and a connection member guide part that opens to a lower side of the latch mounting part to communicate with the latch mounting part, where the connection member is configured to receive and guide the connection member. The refrigerator may include a locking member case in which the locking member is accommodated, a connection member case in which the connection member is accommodated, and a manipulation member case in which the manipulation member is accommodated, where the locking member case, the connection member case, and the manipulation member case are disposed inside the sub door and configured to prevent entry of a foam solution that is filled into the sub door.

Further according to this aspect, the door opening assembly may include a manipulation member exposed to the outside of the sub door and configured to be manipulated by a user, and the manipulation member may be exposed to a grip part that is recessed, where the grip part is configured to be grasped by the user when opening the main door. The manipulation member may be exposed to the outside by passing through a cap deco disposed on an end of the sub door. The door opening assembly may be disposed on an end disposed on a side that faces a rotation shaft of the sub door. The main door may be disposed on each of both left and right sides, the sub door may be disposed on each of the both main doors, and the manipulation member may be disposed on each of ends adjacent to each other on a pair of sub doors. The grip part may extend from one end of the door to the other end of the door. A pair of sub doors may be vertically disposed with respect to the grip part to correspond to a boundary of the main door, and the manipulation members may be disposed to face each other between the grip parts on the pair of sub doors. An end of the sub door on which the manipulation member is disposed may define a boundary of the grip part.

According to another aspect, a refrigerator includes a door configured to open or close a storage space of the refrigerator, a locking member disposed within the door that passes through a back surface of the door, where the locking member is configured to be inserted into and restricted with an accommodation part to thereby maintain a closed state of the door, a manipulation member disposed at a side surface of the door, the manipulation member being spaced apart from the locking member and configured to be manipulated by a user, and a connection member within the door that connects the locking member to the manipulation member to allow the locking member to operate according to the manipulation of the manipulation member, where based on the manipulation member being manipulated, the manipulation member operates the connection member to release the restriction of the locking member to open the door.

Implementations of this aspect may include one or more of the following features. For example, the locking member may be rotatably mounted within the door and configured to rotate to be selectively restricted with a hook part that is disposed inside the accommodation part. An elastic member providing an elastic force for allowing the locking member to return to its original position may be disposed on one side of the locking member. The manipulation member may be disposed on a lower end of the door at an opposite side to a rotation shaft of the door. The manipulation member may include a rotational part rotatably mounted inside the door, a push part disposed on the rotational part and exposed to an outer end of the door, where the push part is configured to be pushed by the user, and a support part extending from the rotational part to contact the connection member so that the connection member vertically moves. The connection part may have a lower end shaft-coupled to the support part. A guide member may be mounted inside the door and include a latch mounting part on which the locking member is rotatably mounted, and a connection member guide part that opens to a lower side of the latch mounting part to communicate with the latch mounting part, the connection member being configured to receive and guide the connection member. The guide member may be molded by using an insulation member and disposed inside the door. A foam solution for molding an insulation material may be filled into the door, and a latch case in which the locking member is accommodated, a connection member case in which the connection member is accommodated, and a manipulation member case in which the manipulation member is accommodated may be disposed on the door to prevent entry of the foam solution.

The details of one or more implementations are set forth in the accompanying drawings and the description below. Other features will be apparent from the description and drawings, and from the claims.

DETAILED DESCRIPTION

Reference will now be made in detail to the implementations of the present disclosure, examples of which are illustrated in the accompanying drawings. The technical scope of the implementations will fall within the scope of this disclosure, and addition, deletion, and modification of components or parts are possible within the scope of the implementations.

Figure 1:
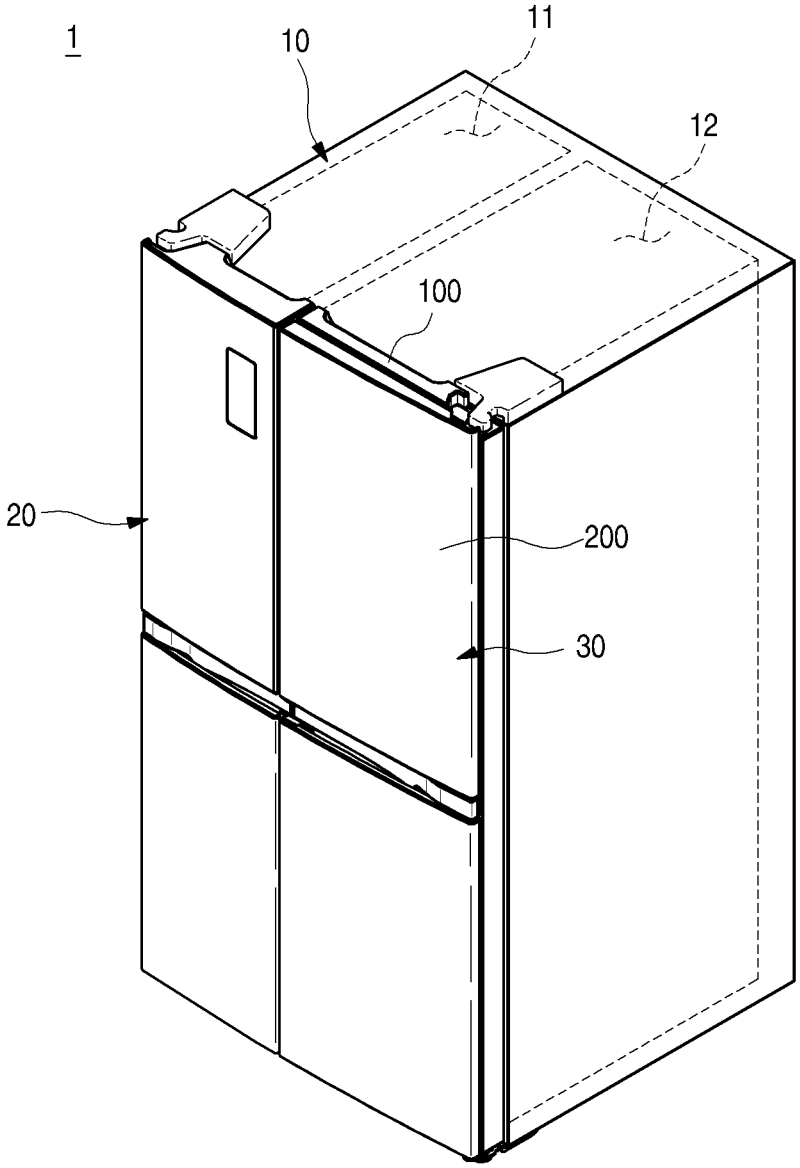
FIG. 1 is a perspective view illustrating an example refrigerator according to one implementation.
Figure 2:
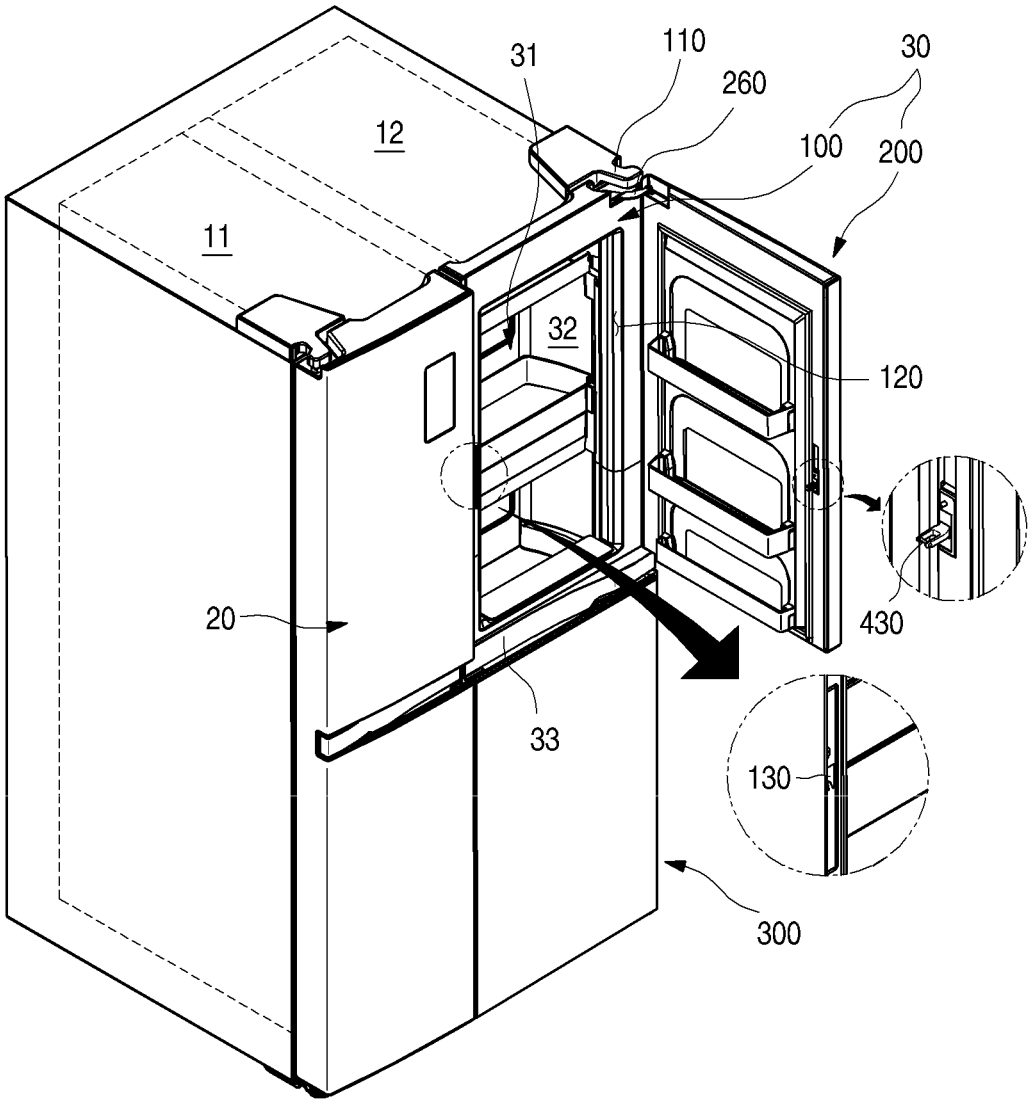
FIG. 2 is a perspective view illustrating the refrigerator with a sub door opened.
Figure 3:
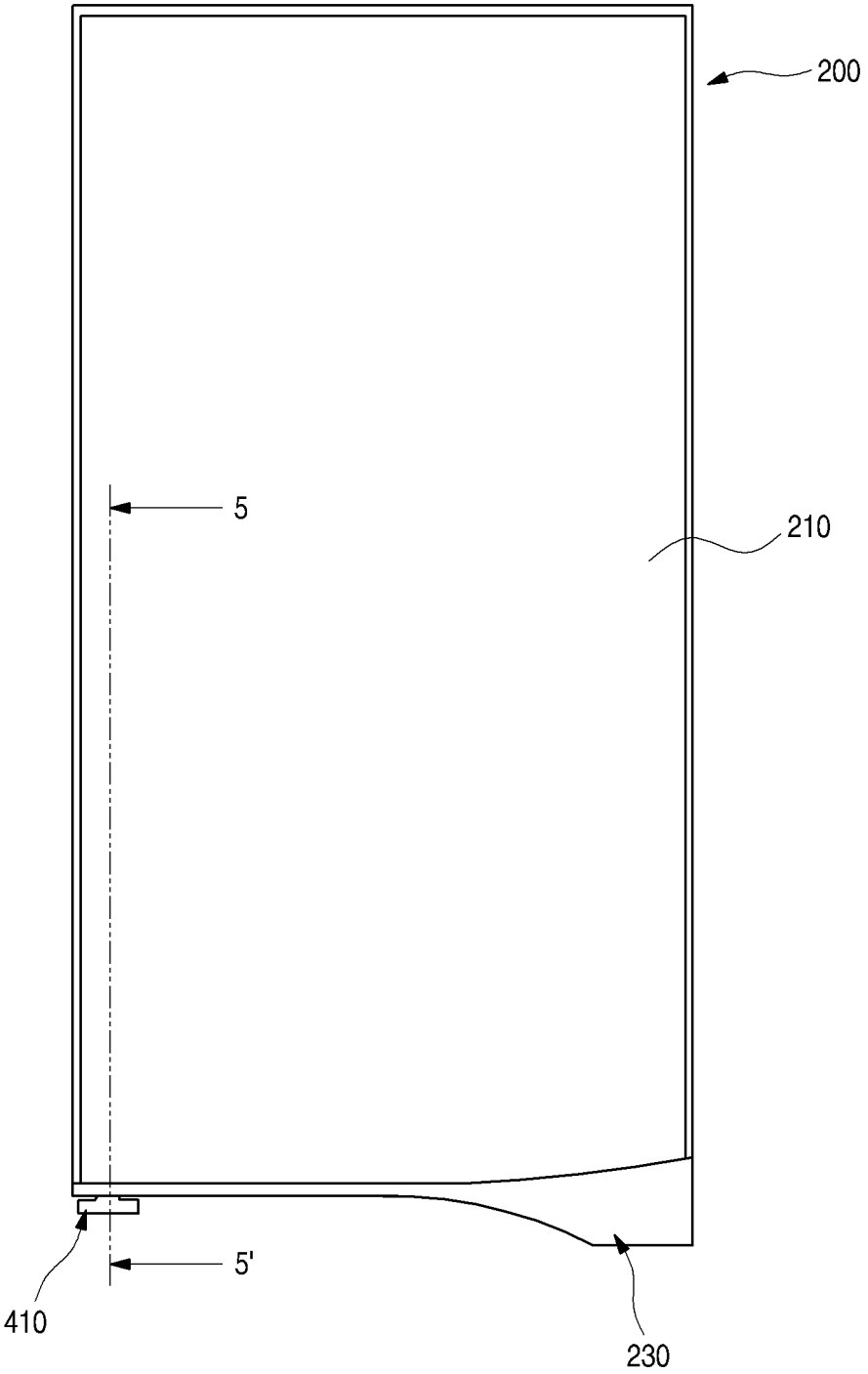
FIG. 3 is a front view of the sub door.

Referring to FIGS. 1 to 3, a refrigerator 1 according to one implementation includes a cabinet 10 defining a storage space and a door for opening or closing the storage space. Here, an outer appearance of the refrigerator 1 may be defined by the cabinet 10 and the door.

The inside of the cabinet 10 may be partitioned into left and right sides to define a freezing compartment 11 and a refrigerating compartment 12. Also, the door may include a freezing compartment door 20 and a refrigerating compartment door 30, which respectively open and close the freezing compartment 11 and the refrigerating compartment 12.

Also, an accommodation device 31 for defining a separate storage space separated from the inside of the refrigerating compartment 12 may be disposed on the refrigerating compartment door 30. Thus, in a state where the refrigerating compartment door 30 is closed, the inside of the refrigerating compartment 12 may be defined as a first storage compartment, and the inside of the accommodation device 31 may be defined as a second storage compartment 32.

The refrigerating compartment door 30 may include a main door 100 for opening or closing the first storage compartment and a sub door 200 for opening or closing the second storage compartment 32.

The main door 100 may have an upper end connected to a top surface of the cabinet 10 by a door hinge 110. Also, the main door may be rotatably coupled to the cabinet 10. Also, a separate hinge may be disposed on a lower end of the main door 100 so that the main door 100 is rotatably mounted. Thus, as the main door 100 rotates, the refrigerating compartment 12 may be opened or closed. The main door rotates to accommodate foods in the refrigerating compartment 12.

Also, an opening 120 may be defined in an upper portion of the main door 100. The opening 120 may extend from a grip part 33 that serves as a handle up to a position adjacent to an upper end of the main door 100. Also, the opening 316 may extend up to a position adjacent to each of both side ends of the main door 100. Also, the accommodation device 31 may be disposed on a back surface of the main door 100 according to a rear side of the opening 120. The accommodation device 31 has a shape that allows being opened in a front direction. Also, foods may be accessible into the accommodation device 31 through the opening 120.

A sealer may be disposed around a back surface of the main door 100 to contact a boundary of a front surface of the cabinet 10 when the main door 100 is closed. The sealer may be formed of an elastically deformable and compressible material. Also, a magnet may be disposed inside the sealer and thus closely attached to the cabinet 10.

Also, the foods accommodated in the accommodation device 31 may be accessible through the opening 120 in the state where the main door 100 is closed. Thus, in a state where the main door 100 covers the refrigerating compartment 12, the opening 120 may be opened to take the foods in or out of the accommodation device 31.

Two openings 120 may be vertically provided with respect to the grip part 33, or at least one accommodation device and sub door 200 may be disposed on each of the freezing compartment door 20 and the refrigerating compartment door 30.

Also, the opening 120 may be further defined in the freezing compartment door 20 and be opened or closed by a separate door. If necessary, only one opening 120 that is opened or closed by the sub door 200 may be provided. That is, the opening 120 may be provided in various positions of the door.

The opening 120 may have a size corresponding to that of a front surface of the accommodation device 31. The opening 120 may vertically overlap the grip part 33 of the main door 100 and be horizontally disposed up to a region except for portions of both left and right ends of the main door 100. Thus, since the opening is defined to correspond to the most of an upper area of the refrigerating compartment door 30, a size and utility of the opening 120 may be significantly different from those of a home bar that is used in a general refrigerator.

The grip part 33 may be configured to open or close the refrigerating compartment door 30, i.e., the main door 100. The grip part 33 may be disposed along a horizontal length at a central portion of the main door 100 and have a shape that is recessed so that a user may pull the grip part 33 by using his or her hand. The grip part 33 may be disposed at a position that is easily grasped by the user and also may form a lower boundary with an upper portion of the refrigerating compartment door 30 such that the refrigerating compartment door 30 including the sub door 200 is shown as one main door 100.

The grip part 33 may have a shape that is recessed inward and downward so that the user may easily grasp the grip part 33. Also, the grip part 33 may be disposed with the same shape on the freezing compartment door 20. When viewed from a front side, the grip part 33 may be disposed at the same height as that from a left end to a right end of the refrigerator 1. Thus, even though the sub door 200 is disposed on the refrigerating compartment door 30, when viewed from the front side, the refrigerating compartment door 30 and the freezing compartment door 20 may be seen as if they have the same shape.

The sub door 200 may be configured to open or close the opening 120. The sub door 200 is rotatably mounted on the main door 100 by using an upper hinge 260. The upper hinge 260 may be configured so that both ends of the upper hinge 260 are shift-coupled to a top surface of the main door 100 and a top surface of the sub door 200 to rotate by using the main door 100 as an axis.

Also, a lower hinge may be further disposed on a lower end of the sub door 200. The lower hinge may be disposed on the lower end of the sub door 200 and be mounted on the main door 100 to rotatably support the sub door 200. The lower hinge may have a cam structure or spring structure so that the sub door 200 is more smoothly opened or closed.

Thus, the main door 100 and the sub door 200 may independently rotate with respect to each other. The main door 100 and the sub door 200 may be independently manipulated to selectively open or close the refrigerating compartment 12 and the opening 120.

A front surface of the sub door 200 may be formed of the same material as the freezing compartment door 20. Also, a design or pattern may be continuously formed on the front surface of the sub door 200. Also, the front surface of the sub door 200 may be disposed on the same plane as that of the freezing compartment door 20 in the state where the sub door 200 is closed.

Also, a boundary of the sub door 200 except for a lower end of the sub door 200 adjacent to the grip part 33 may correspond to a boundary of the main door 100. Thus, in the state where the sub door 200 is closed, when viewed from the front side, the connection portions on which the sub door 200 is disposed may be hidden from view.

Thus, in the state where the sub door 200 is closed, when viewed from the front side, the front surfaces of the refrigerating compartment door 30 and the freezing compartment door 20 may be seen as if they have the same shape. That is, the whole of the refrigerating compartment door 30 may be viewed by the user as being a single door.

A door basket for accommodating foods may be disposed on a back surface of the sub door 200. The door basket may be detachably mounted and be adjusted in mounting position so that the door basket can be height-adjustably mounted on the back surface of the sub door 200.

Also, a locking member 430 may be disposed on the back surface of the sub door 200. Also, a receiving part 130 may be defined in one side of the main door 100 that corresponds to the locking member 430.

When the sub door 200 is closed, the locking member 430 may be inserted into the receiving part 130. The locking member 430 may be restricted within the receiving part 130 in the state where the locking member 430 is inserted into the receiving part 130 to maintain the closed state of the sub door 200.

Also, a manipulation member 410 may be disposed on a lower end of the sub door 200. The manipulation member 410 may be configured to allow the user to manipulate an operation of the locking member 430. The manipulation member 410 may be disposed on a corner of a lower end of the sub door 200. Here, the manipulation member 410 may be disposed on a corner of the sub door 200 that is far away from the rotation shaft so that the sub door 200 easily rotates.

Also, the sub door 200 may include a door opening assembly 400 including the locking member 430 and the manipulation member 410 to open or close the sub door 200. Hereinafter, a structure of the door opening assembly 400 will be described in more detail with reference to the accompanying drawings.

Figure 4:
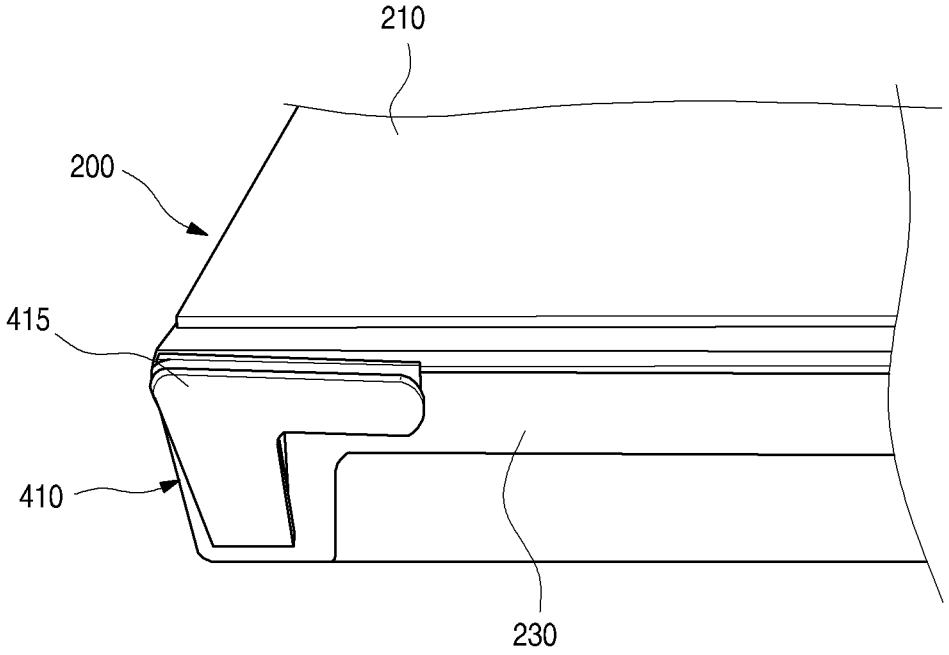
FIG. 4 is a perspective view of a lower end of the sub door.
Figure 5:
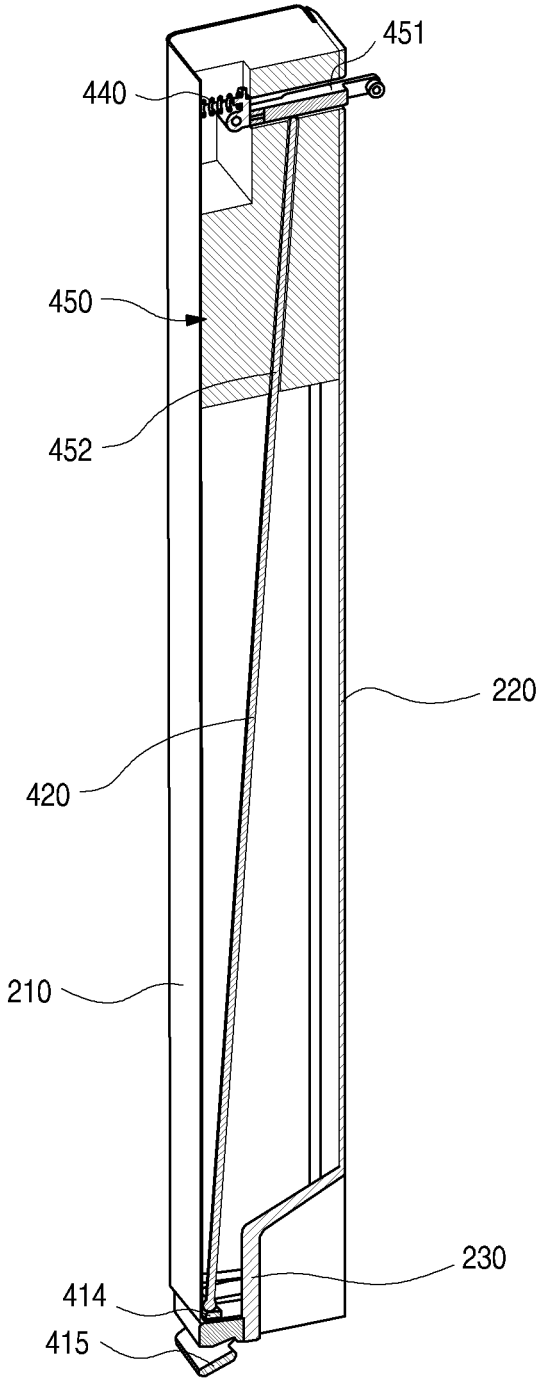
FIG. 5 is a cross-sectional perspective view taken along line 5-5' of FIG. 3.
Figure 6:
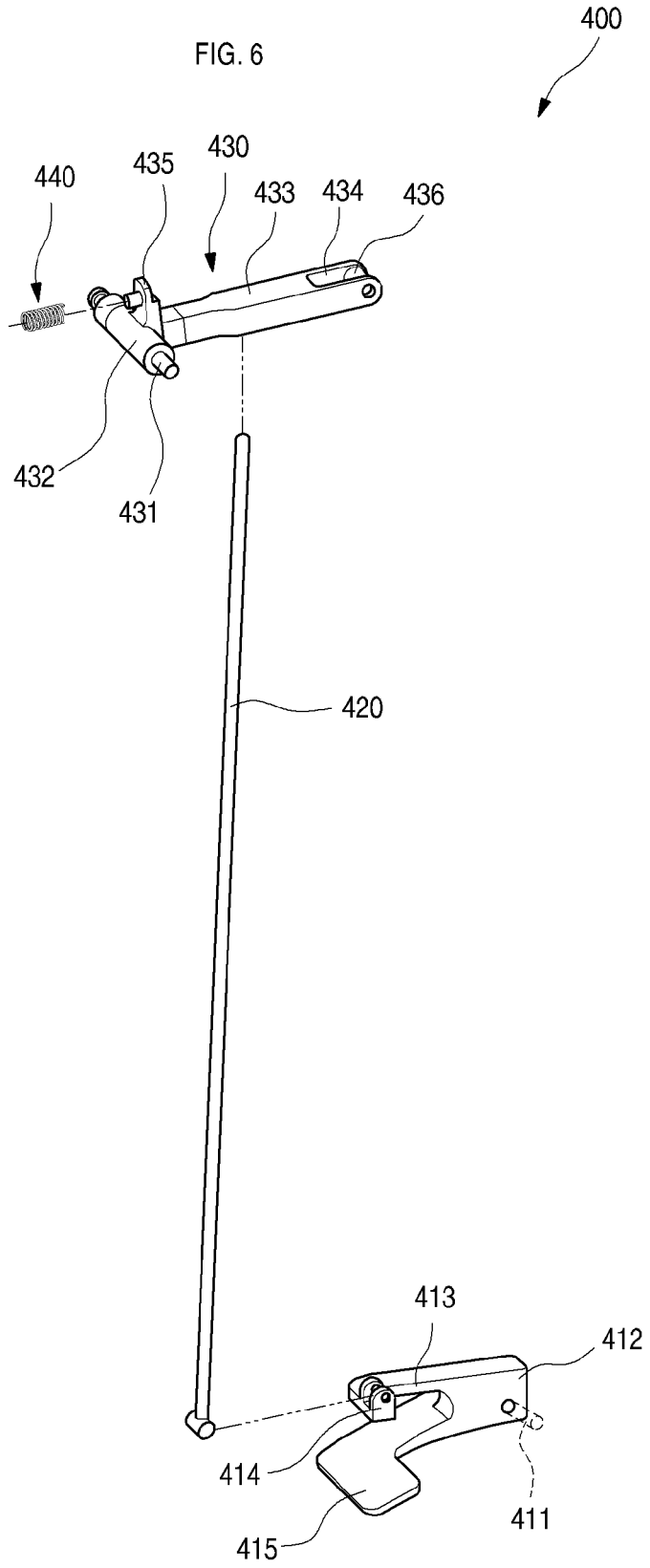
FIG. 6 is an exploded perspective view of a door opening assembly.

As illustrated in FIGS. 4 to 6, the door opening assembly may include the manipulation member 410 that is manipulated by the user, the locking member 43 inserted and restricted into the accommodation part 130, and a connection member connected to the manipulation member 410 to allow the locking member to be operable.

In detail, the manipulation member 410 is disposed on the lower end of the sub door 200. The manipulation member 410 may be one component of the door opening assembly 400 to allow the locking member 430 to be operable. Also, the manipulation member 410 is disposed on a corner of the lower end of the sub door 200.

The manipulation member 410 may protrude to the outside in the state where the manipulation member 410 is disposed on the lower end of the sub door 200 so that the user is capable of manipulating the manipulation member 410. Here, only a portion of the manipulation member 410 that is manipulated by the user may be exposed to the grip part 33 disposed at a center of the refrigerating compartment door 30. That is, the exposed portion of the manipulation member 410 may be minimized when the user sees the refrigerator. The manipulation member 410 may be mounted on a cap deco 230 defining the lower end of the sub door 200 and also rotates by the user's manipulation.

Explaining the manipulation member 410 in more detail, the manipulation member 410 may include a rotational part 412 in which a hinge shaft 411 is inserted, a support part 413 extending from an upper portion of the rotational part 412, and a push part 415 extending from a lower portion of the rotational part 412.

The manipulation member 410 may be shaft-coupled to the cap deco 230 through the hinge shaft 411. Also, the support part 413 extends forward from the upper portion of the rotational part 412 and has an end shaft-coupled to an end of the connection member 420. Also, the push part 415 extends forward from the lower portion of the rotational part 412. Here, the push part 415 may be inclined or rounded so that the push part 415 is gradually away from the support part 413 in the extension direction thereof. The push part 415 may have a wide cross-sectional area on the extending end thereof so that the user easily manipulates the push part 415.

Also, in the state where the manipulation member 410 is mounted on the cap deco 230, the support part 413 and the rotational part 412 except for the push part 415 of the manipulation member 410 may be disposed inside the cap deco 230, and thus, only the push part 415 may be exposed downward from the cap deco 230. Here, a front end of the push part 415 is configured so that the user pushes the push part 415 to allow the manipulation member 410 to rotate in a state where the front end of the push part 415 is spaced apart from a lower end of the cap deco 230.

A lower end of the connection member 420 is shaft-coupled to a connection member coupling part 414 disposed on the support part 413. Thus, when the manipulation member 410 rotates, the connection member may vertically move.

The connection member 420 may have a long rod shape. The connection member 420 may have the lower end shaft-coupled to the connection member coupling part 414 and an upper end contacting a bottom surface of the locking member 430 in a state where the upper end of the connection member 420 is not fixed. Here, the upper end of the connection member 420 that is in contact with the locking member 430 may be disposed at a point that is away from the rotation shaft 431 of the locking member 430. Thus, when the connection member 420 vertically moves, the locking member 430 may rotate about the rotation shaft 431 thereof.

Also, an insulation material may be disposed between an outer case 210 defining an exterior of the sub door 200 and a door liner 220 defining the inside of the sub door 200. A guide member 450 for guiding the movement of the connection member 420 may be disposed on the sub door 200.

The guide member 450 may be disposed on a position on which the locking member 430 is disposed. A connection member guide part 452 disposed inside the sub door 200 to accommodate the connection member 420 and a locking member mounting part 451 on which the locking member 430 is mounted may be disposed on the guide member 450. The guide member 450 may perform an insulation function within the sub door 200. For this, the guide member 450 may be formed of a polyethylene material having superior insulation performance.

The locking member 430 may be rotatably mounted on the locking member mounting part 451 of the guide member 450. The locking member 430 has a rear end shaft-coupled to the inside of the locking member mounting part 451 and a front end passing through the door liner 220 to protrude backward.

In more detail, the locking member 430 has a predetermined width and be extended in a front/rear direction. Also, a shaft coupling part 432 shaft-coupled to the inside of the guide member 450 or the sub door 200 may be disposed on a rear end of the locking member 430.

Also, an elastic member support part 435 by which an elastic member 440 is supported may be disposed above the shaft coupling part 432. The elastic member 440 may provide an elastic force to allow the locking member 430 to be horizontally maintained. The elastic member 440 may support the elastic member support part 435 at the locking member mounting part 451.

A body 433 extending backward may be disposed on the shaft coupling part 432. The body 433 extends to pass through the locking member mounting part 451. The body 433 may have an end that protrudes to pass through the back surface of the sub door 200.

In some cases, a restriction part 434 is disposed on the end of the body 433. The restriction part 434 may be coupled to a hook part 131 disposed on the accommodation part 130 and having a projection shape when the locking member 430 is inserted into the accommodation part 130.

In detail, the restriction part 434 may be provided to allow a front portion of the body 433 to be opened. Also, the hook part 131 may be accommodated into the restriction part 434. Also, a restriction roller 436 may be rotatably disposed on a front end of the restriction part 434. The restriction roller 436 may induce hooking and restriction between the restriction part 434 and the hook part 131 while moving along a slope 132 of the hook part 131.

In the guide member 450, the locking member mounting part 451 through which the body 433 passes may have a vertical width greater than a thickness of the body 433. Also, the locking member mounting part 45 may have a space in which the body 433 moves while the locking member 430 rotates.

Also, the locking member mounting part 451 may communicate with an upper end of the connection member guide part 452. An upper end of the connection member 420 passing through the connection member guide part 452 may support a bottom surface of the body 433 within the locking member mounting part 451 to rotate the locking member 430.

Hereinafter, an operation of the door opening assembly will be described in more detail with reference to the accompanying drawings.

Figure 7:
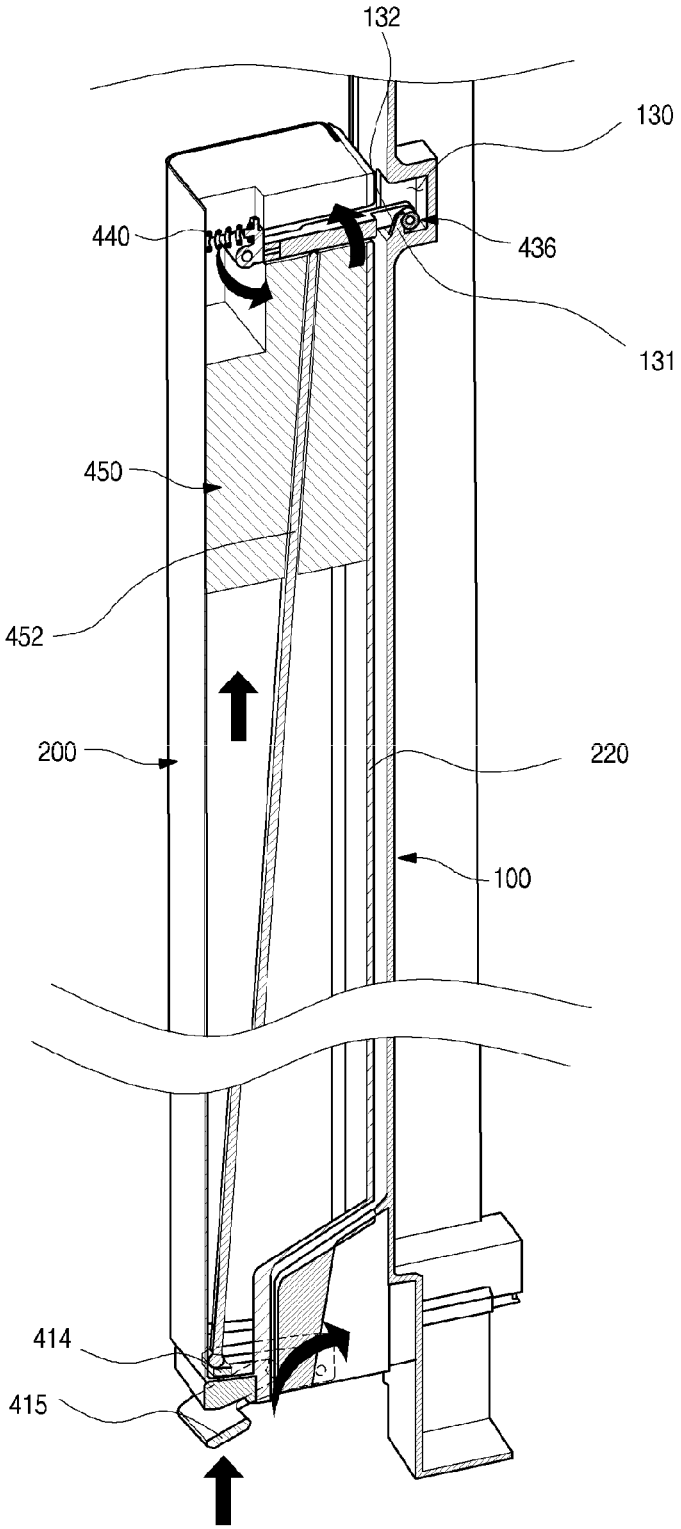
FIG. 7 is a view illustrating the door opening assembly in a state where the sub door is closed.

Referring now to FIG. 7, in the state where the sub door 200 is closed, the back surface of the sub door 200 may be closely attached to the front surface of the main door 100. Here, the locking member 430 may be fixed in the state where the locking member 430 is accommodated into the accommodation part 130.

In the state where the sub door 200 is fully closed, the locking member 430 may be restricted in the state where the hook part 131 of the accommodation part 130 is inserted into the restriction part 434 of the locking member 430. Thus, the sub door 200 may be maintained in the closed state.

Here, the locking member 430 may be in a horizontal state. Also, the elastic member 440 may support the locking member 430 in a state where the elastic member 440 is not compressed. Also, a bottom surface of the locking member 430 may be in contact with the upper end of the connection member 420, and the connection member 420 may not transmit other external forces to the locking member 430.

The manipulation member 410 is connected to a lower end of the connection member 420, and the push part 415 is exposed to the outside through the lower end of the sub door 200. Also, the push part 415 may be pushed in a state where the push part 415 is away from the bottom surface of the sub door 200 to allow the manipulation member 410 to rotate.

In this state, if intending to open the sub door 200, the user may rotate the locking member 430 through the manipulation of the manipulation member 410 to release the restriction between the locking member 430 and the accommodation part 130, thereby opening the sub door 200.

Figure 8:
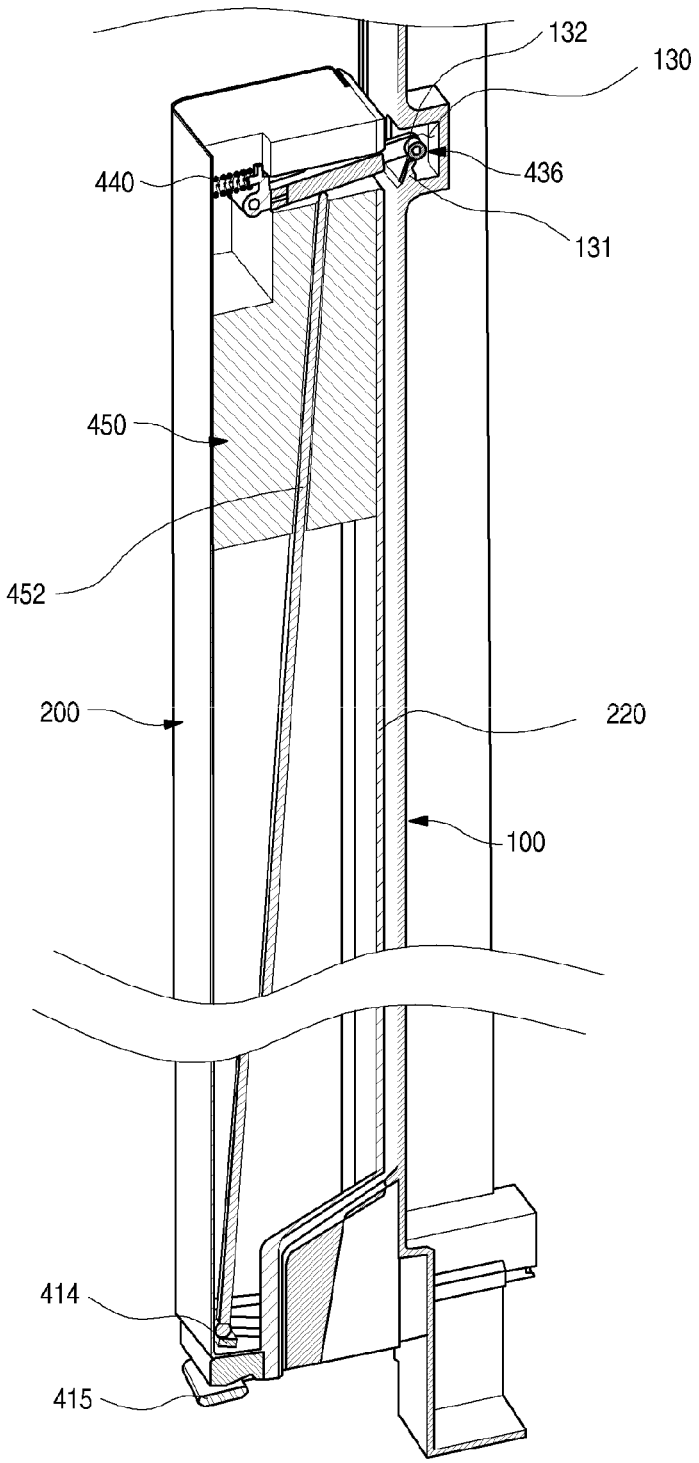
FIG. 8 is a view illustrating the door opening assembly in a state where the sub door is opened.

As illustrated in FIG. 8, to open the sub door 200, the user can push the push part 415 of the manipulation member 410. When the push part 415 is pushed, the manipulation member 410 rotates about the rotation shaft 411 of the manipulation member 410, and thus the support part 413 moves upward.

As the support part 413 moves, the connection member 420 connected to the support part 413 may also move upward. Here, the connection member 420 may stably move upward by the guide member 450. The upper end of the connection member 420 may lift the bottom surface of the locking member 430.

The locking member 430 may rotate about the rotation shaft of the locking member 430 by the upper end of the connection member 420. Here, the elastic member 440 is compressed. As the locking member 430 rotates, the restriction part 434 disposed on the front end of the locking member 430 may be lifted upward. Thus, the restriction part 434 hooked and restricted with the hook part 131 of the accommodation part 130 may be released, and the sub door 200 may freely rotate and be opened.

Here, since the user pushes the manipulation member 410 disposed at a position that is away from the rotation shaft of the sub door 200 to manipulate the manipulation member 410, the user may rotate the sub door 200 while the user pushes the manipulation member 410 or grasps the corresponding portion after pushing the manipulation member 410.

Also, if the user separates his or her hand from the push part 415 after the sub door 200 is opened, the locking member 430 may rotate by an elastic restoring force of the elastic member 440 and then return to its initial horizontal state. Thus, the connection member 420 may also move upward, and the manipulation member 410 connected to the connection member 420 may also rotate. Here, the push part 415 may also protrude downward from the sub door 200 so that the manipulation member 410 is in the manipulable state.

When the sub door 200 is closed in the state where the locking member 430 returns to its initial state, the restriction roller 436 disposed on the front end of the locking member 430 moves along the slope 132 of the hook part 131, and thus, the locking member 430 smoothly rotates to compress the elastic member 440.

Also, when the restriction roller 436 passes over the slope 132 of the hook part 131, the hook part 131 is inserted into the restriction part 434 of the locking member 430, and the locking member 430 may be in the restricted state as illustrated in FIG. 7. The state in which the locking member 430 is hooked and restricted within the accommodation part 130 may be a state in which the sub door 200 is closely attached to the main door 100. Here, the closely attached state of the sub door 200 may be maintained before the manipulation member 410 is manipulated.

A refrigerator may be realized according to various other implementations different from the foregoing implementation.

For example, a refrigerator according to another implementation may include a door opening assembly having a structure different from that of the above-described door opening assembly.

For example, a refrigerator according to a second implementation may have largely similar components as the foregoing implementation except for a door opening assembly and elements connected to the door opening assembly. Thus, their duplicated descriptions may be denoted by the same reference numeral, and also, their detailed description will be omitted.

Figure 9:
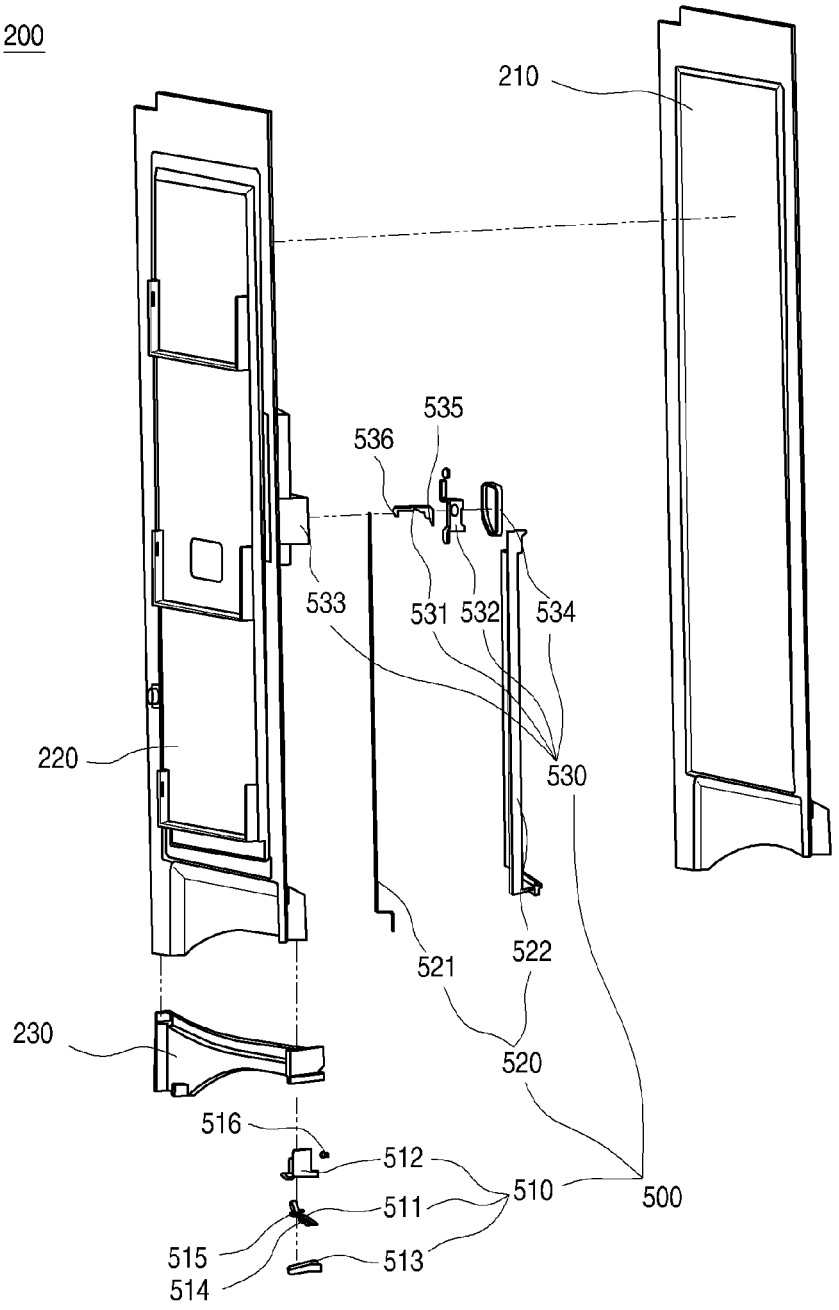
FIG. 9 is an exploded perspective view illustrating an example sub door according to a second implementation.
Figure 10:
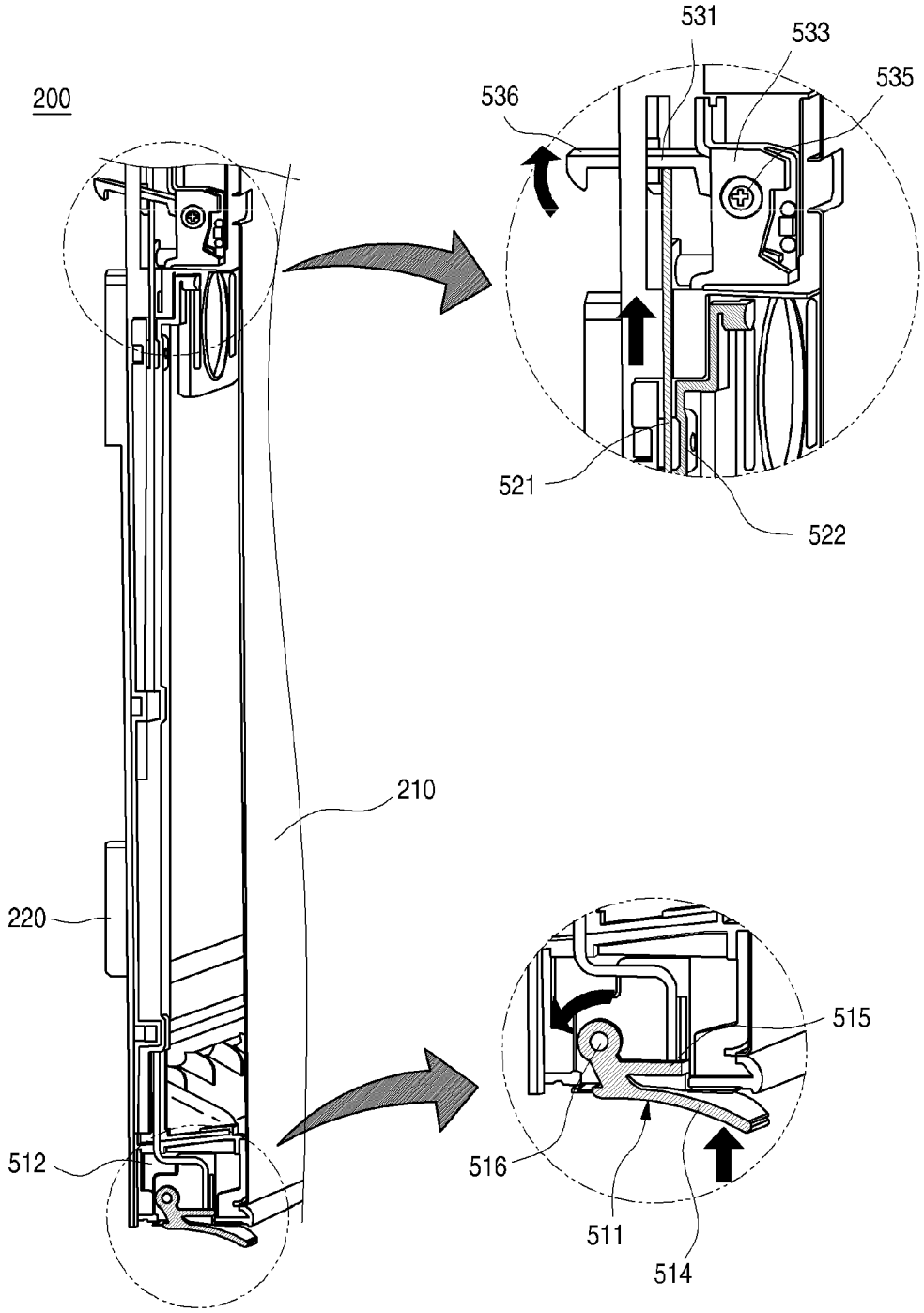
FIG. 10 is a cross-sectional perspective view illustrating an operation state of a door opening assembly according to the second implementation.

Referring now to FIGS. 9 and 10, a refrigerator door 200 according to the second implementation includes an outer case 210 defining an outer surface thereof and a door liner 220 defining an inner surface thereof. Here, an exterior of the refrigerator may be defined by the outer case 210 and the door liner 220. Also, the cap deco 230 may be mounted on a lower end at which the outer case 210 and the door liner 220 are coupled to each other. Also, a door opening assembly 500 may be disposed inside the door 200.

The door opening assembly 500 includes a manipulation unit 510 to be manipulated by a user, a locking unit 530 for maintaining a closed state of the door, and a connection unit 520 for allowing the manipulation unit 510 to be interlocked with the locking unit 530.

Also, an insulation material for insulation may be mounted by being foamed and filled into the door 200. Here, the door opening assembly 500 may be buried by the insulation material. Also, the inner components of the door opening assembly 500 may be operable without being affected by the insulation material.

In detail, the manipulation unit 510 may include a manipulation member 511 that can be pushed and manipulated by the user, a manipulation member case 512 mounted inside the door 200 to provide a space in which the manipulation member 511 is accommodated, and a case cover 513 coupled to the manipulation member case 512 to cover an opened surface.

The manipulation member 511 is rotatably mounted inside the manipulation member case 512. When a push part 514 rotates, the manipulation member 511 may rotate. Also, the push part 514 may protrude downward from the door 200 to protrude. When the push part 514 is pushed, the manipulation member 511 is inserted into the manipulation member case 512 while rotating.

Also, a support part 515 supporting a lower end of the connection member 521 is disposed on the manipulation member 511. The support part 515 extends forward from a rotation shaft 516 of the manipulation member 511. Here, the support 515 may horizontally extend to stably support the lower end of the connection member 521.

Also, a lower portion of the connection member 521 may pass through a top surface of the manipulation member case 512 and then be inserted into the manipulation member case 512. Thus, the connection member 521 may be maintained in contact with the support part 515 of the manipulation member 511.

The locking unit 530 may be disposed above the manipulation unit 510, i.e., disposed at an approximately central portion of a vertical height of the door. Here, an accommodation part in which the locking member 531 of the locking unit 530 is selectively hooked and restricted like the foregoing implementation may be provided in a main body or the other door of the refrigerator corresponding to the locking unit 530.

The locking unit may include a locking member 531 hooked and restricted with an accommodation part provided in an object that is hooked and restricted for fixing the door 200, a locking member bracket 532 on which the locking member 531 is rotatably mounted, a locking member case 533 accommodating the locking member 531 and the locking member bracket 532, and a case cover 534 covering an opened portion of the locking member case 533.

In detail, the locking member case 533 may have opened front and rear surfaces. The front surface of the locking member case 533 may be disposed to correspond to an opened side of a door liner 220 and then be mounted on the opened side of the door liner 220. Also, the case cover 534 is mounted on an opened rear surface of the locking member case 533 to provide a space in which the locking member 531 and the locking member bracket 532 are accommodated.

The locking member 531 passes through the locking member case 533 and the door liner 220 to protrude. Also, a restriction part 536 having a hook shape may protrude outward from the locking member 531. Thus, the restriction member 536 may be fixed to a hook part of the refrigerator body or the other door due to the selective rotation of the locking member 531.

A rotation shaft 535 of the locking member 531 may be rotatably mounted on the locking member bracket 532. An elastic member 537 such as a torsion spring may be disposed on the rotation shaft 535. Thus, when the locking member 531 rotates, the elastic member 537 may provide an elastic force for allowing the locking member 531 to return to its original position.

A connection unit 520 is disposed between the manipulation unit 510 and the locking unit 530. The connection unit may be disposed along a vertical direction to connect the locking unit 530 to the manipulation unit 510.

In detail, the connection unit 520 may include a connection member 521 for allowing the manipulation member 511 to be interlocked with the locking member 531 and a connection member case 522 providing a space in which the connection member 521 is accommodated.

The connection member 521 may have a rod shape having a predetermined length. The connection member 521 has an upper end contacting a bottom surface of the locking member 531 and a lower end contacting the support part 515 of the manipulation member 511. Also, the lower portion of the connection member 521 may be bent to contact a lower end of the support part 515 that is disposed at a rear side within the manipulation member case 512. Thus, when the manipulation member 511 rotates, the manipulation member 511 may stably vertically move by the connection member 521.

The connection member case 522 may be fixed to a back surface of the door liner 220, and upper and lower ends of the connection member case 522 may be fixed to the locking member case 533 and the manipulation member case 512, respectively. Also, the connection member case 522 can have an inner space. The connection member 521 is accommodated into the inner space of the connection member case 522 so that the connection member 521 is vertically movable within the inner space when the door liner 220 is mounted. Also, when an insulation material is injected into the door 200, introduction of the insulation material into the connection member case 522 may be prevented.

In the operation of the door opening assembly 500 having the above-described structure according to the second implementation, when the manipulation member 511 is manipulated, the connection member 521 moves vertically. As the connection member 521 moves, the locking member 531 rotates, and thus, an object is selectively hooked or restricted with the locking member 531 to allow the door 200 to be opened or maintained in the closed state.

In a door opening assembly according to a third implementation, the door opening assembly includes a locking member, a manipulation member, a connection member, and a push rod which are disposed on a sub door. Also, a locking unit that operates by the push rod is disposed on a main door.

Figure 11:
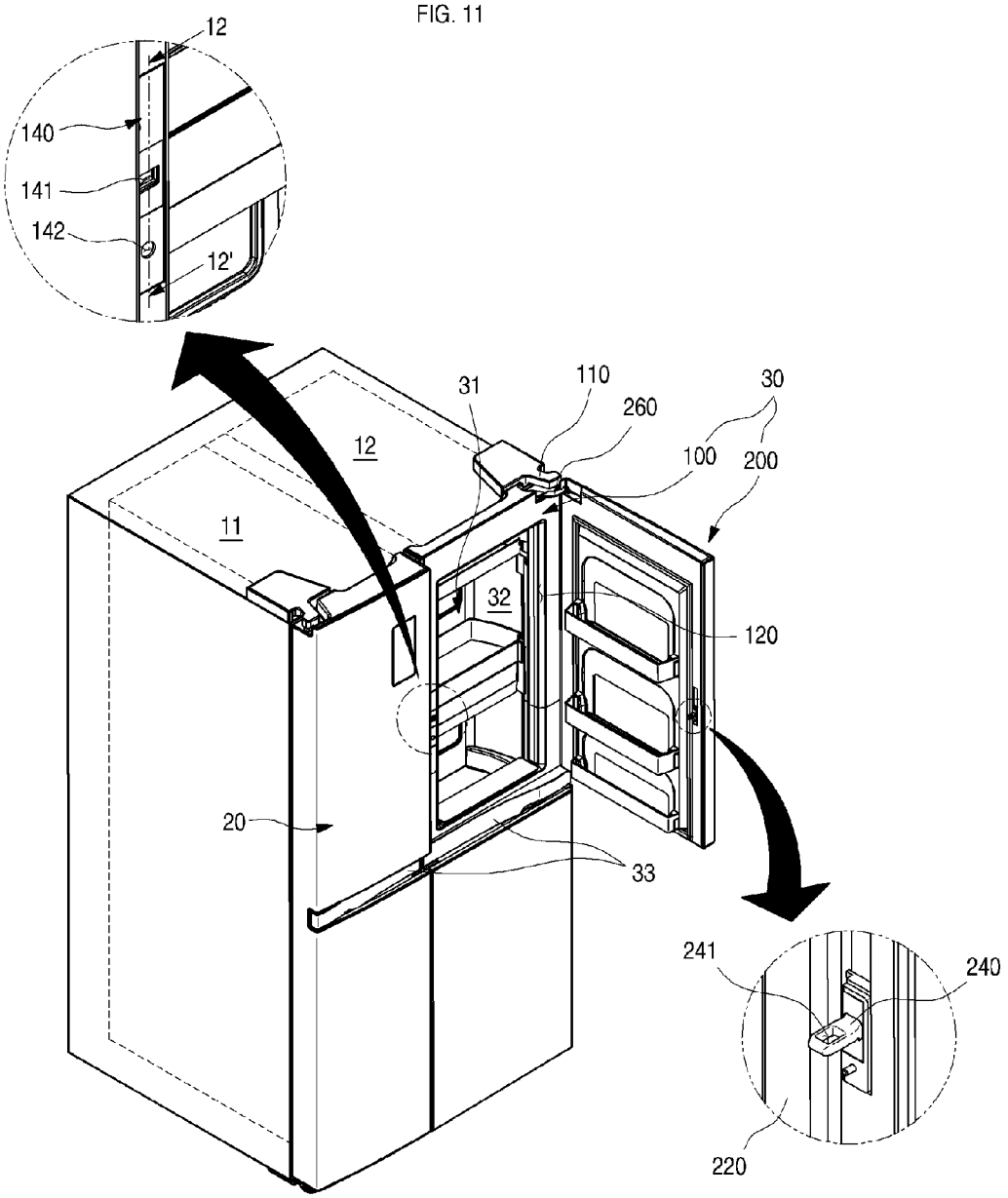
FIG. 11 is a perspective view illustrating a state in which a sub door is opened according to a third implementation.
Figure 12:
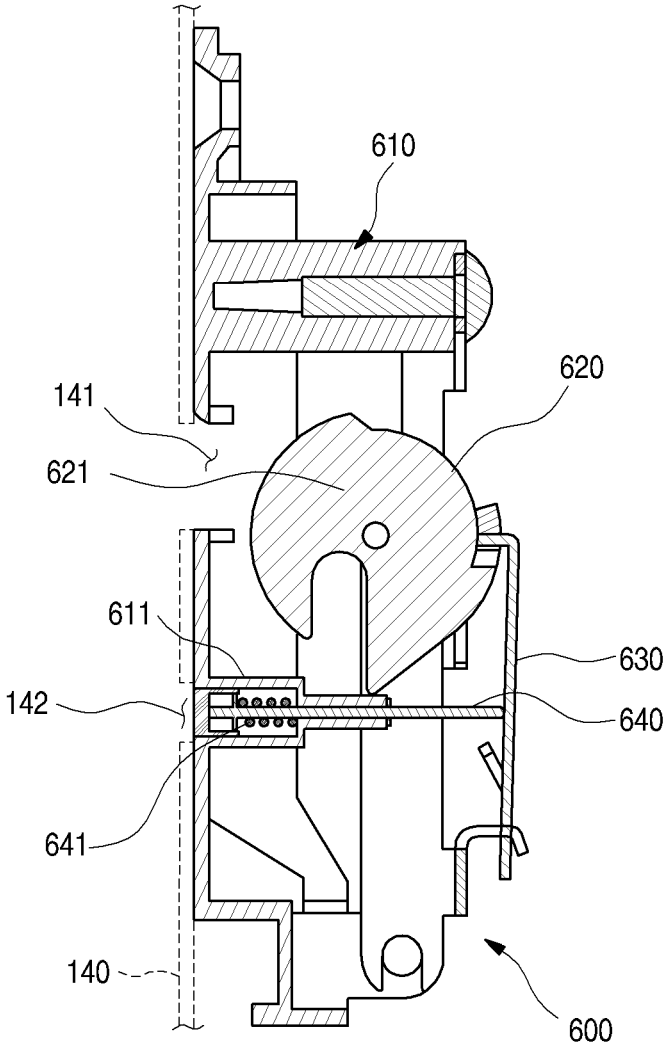
FIG. 12 is a cross-sectional perspective view taken along line 12-12' of FIG. 11.

For example, referring now to FIGS. 11 and 12, a locking unit 600 may be disposed on one side of the front surface of the main door 100 that is away from the rotation shaft of the main door 100. The locking unit 600 may maintain the closed state of the sub door 200. In addition, the locking unit 600 may selectively restrict a locking member 240 disposed on the sub door 200 by the user's manipulation to selectively restrict the sub door 200.

The locking member 240 may be disposed on the back surface of the sub door 200 to protrude from a central portion of one end of the back surface of the sub door 200. Also, the locking unit 600 may be disposed on the front surface of the main door 100 corresponding to the locking member 240.

Thus, when the sub door 200 is closed, the locking member 240 may be inserted into the locking unit 600 and thus be selectively coupled to the locking unit 600.

Also, a cover plate 140 for covering a front surface of the locking unit 300 may be disposed on the front surface of the locking unit 600. Alternatively, the locking unit 600 may directly contact the back surface of the main door 100. In this case, the front surface of the main door 100 may serve as the cover plate 140.

The locking unit 600 may be fixed and mounted inside the main door 100 and be disposed on a back surface of the cover plate 140. Also, an opening rod 640 that is pushed by a push rod 730, which will be described later, is mounted on the locking unit 600. The opening rod 640 is elastically supported by an elastic member 641 such as a spring within the locking unit 600.

In detail, the locking unit may include a locking unit case 610 defining an exterior thereof and fixedly mounted on the inside of the main door 100, a latch cam 620 rotatably mounted on the inside of the locking unit case 610 and selectively coupled to the locking member 240 to restrict the locking member 240, a stopper 630 selectively restraining rotation of the latch cam 620, and an opening rod 640 moving the stopper 630 to allow the latch cam 620 to rotate.

The locking unit case 610 has one side that is opened so that the locking member 240 can be inserted therein. Also, the locking unit case 610 has a space in which the latch cam 620, the stopper 630, and the opening rod 640 are mounted.

The latch cam 620 is rotatably disposed inside the locking unit case 610. When the latch cam 620 rotates, the latch cam 620 may return to its original position by a torsion spring disposed on a rotation shaft thereof.

Also, a latch insertion part 621 in which the locking member 240 is inserted is disposed in the latch cam 620. The latch insertion part 621 may be recessed to be selectively coupled to the locking member 240. Thus, when the sub door 200 is closed, the latch insertion part 621 rotates by the locking member 240 inserted through a latch slot 141 and simultaneously is coupled to the locking member 240 to restrict the locking member 240.

Also, a hook part having a projection or groove shape that is provided on or in a general push switch may be disposed on an outer surface of the latch cam 620. The stopper 630 may rotate in one direction by the pushing manipulation and thus be hooked and restricted to the hook part or be released from restriction with the hook part. The hook part may have various shapes.

The stopper 630 for selectively restraining the rotation of the latch cam 620 is disposed under the latch cam 620. The stopper 630 may be shaft-coupled or coupled in a manner similar to the shaft-coupling so that a lower end of the stopper 630 moves in a left/right or front/rear direction. When the latch cam 620 rotates, a lower end of the stopper 630 may move along the hook part disposed on the outer surface of the latch cam 620. The stopper 630 may connected to one side of the locking unit case 610 by an elastic member such as a spring. The stopper 630 may move in the front/rear or left/right direction and then return to its original position by an elastic force of the elastic member.

A rod mounting part 611 on which the opening rod 640 is mounted movable in a front/rear direction is disposed at a front side of the stopper 630. The rod mounting part 611 may be opened to a front side of the locking unit case 610. In this case, the rod mounting part 611 may be disposed at a position corresponding to that of the push rod 730 (see FIG. 15).

The opening rod 640 may be mounted on the rod mounting part 611. The opening rod 640 may have a front end disposed in a rod hole 142 defined in the cover plate 140 and a rear end contacting the stopper 630. Also, a rod support part may protrude outward from the opening rod 640 to interfere with the rod mounting part 611, thereby restraining the forward movement of the opening rod 640. Since the opening rod 640 is supported by the elastic member 641 such as a spring, when external force is removed after the opening rod 640 moves backward, the opening rod 640 may return to its original position by the elastic force of the elastic member 617.

Thus, as the push rod 730 moves backward, when the opening rod 640 moves backward, the opening rod 640 may push the stopper 630 to separate the stopper 630 from the latch insertion part 621 of the latch cam 620. Simultaneously, the latch cam 620 rotates to separate the latch cam 620 and the locking member 240 from each other.

The cover plate 140 has a plate shape, and a latch slot 141 that is opened so that the locking member 240 is inserted is defined in the cover plate 140. Also, a rod hole 142 is defined in the cover plate 140 corresponding to the opening rod 640. The rod hole 142 may be disposed at a position corresponding to the push rod 730 to allow the push rod 730 to be accessible.

Figure 13:
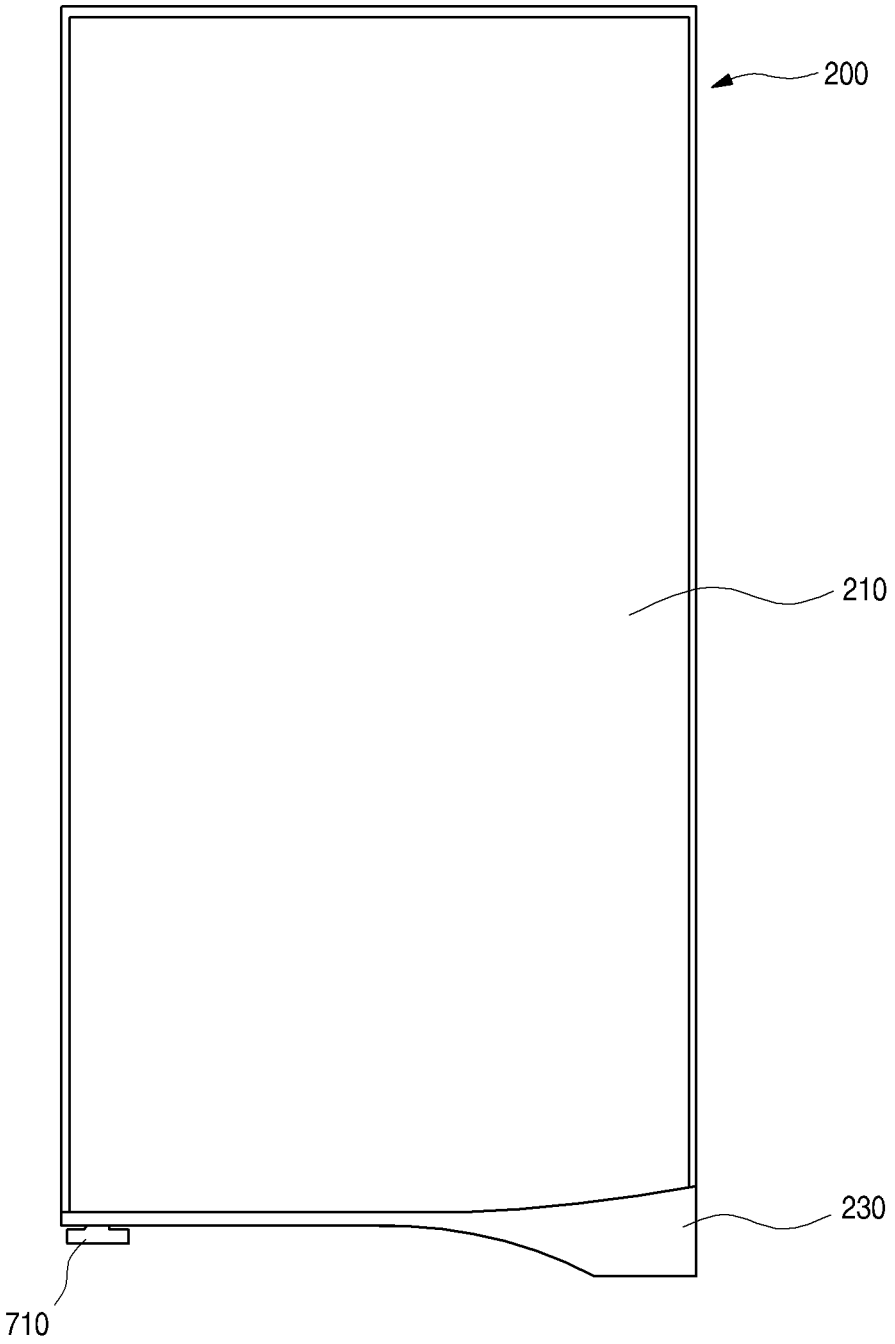
FIG. 13 is a front view of the sub door.
Figure 14:
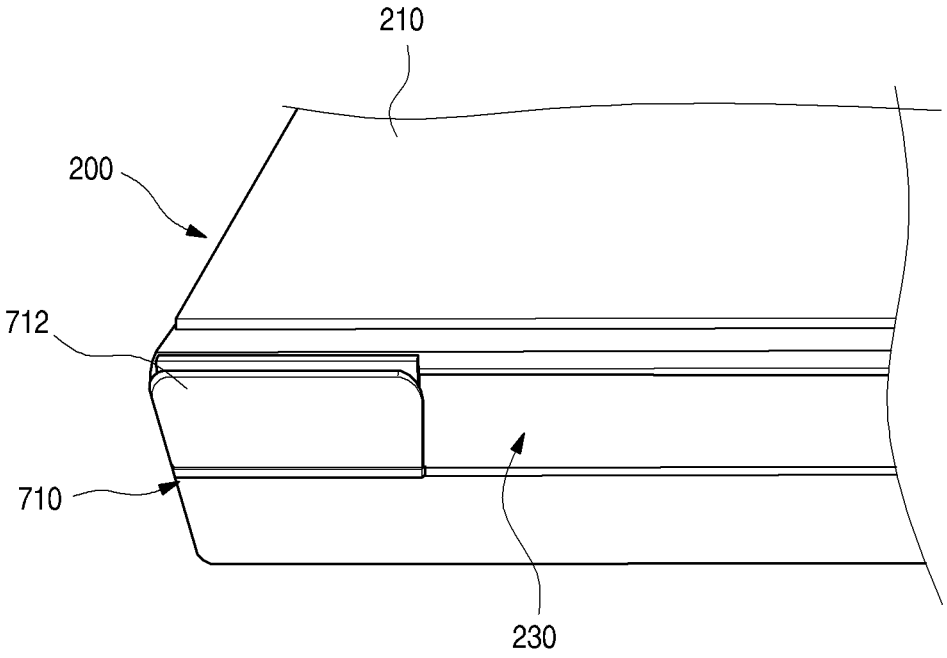
FIG. 14 is a perspective view of a lower end of the sub door.
Figure 15:
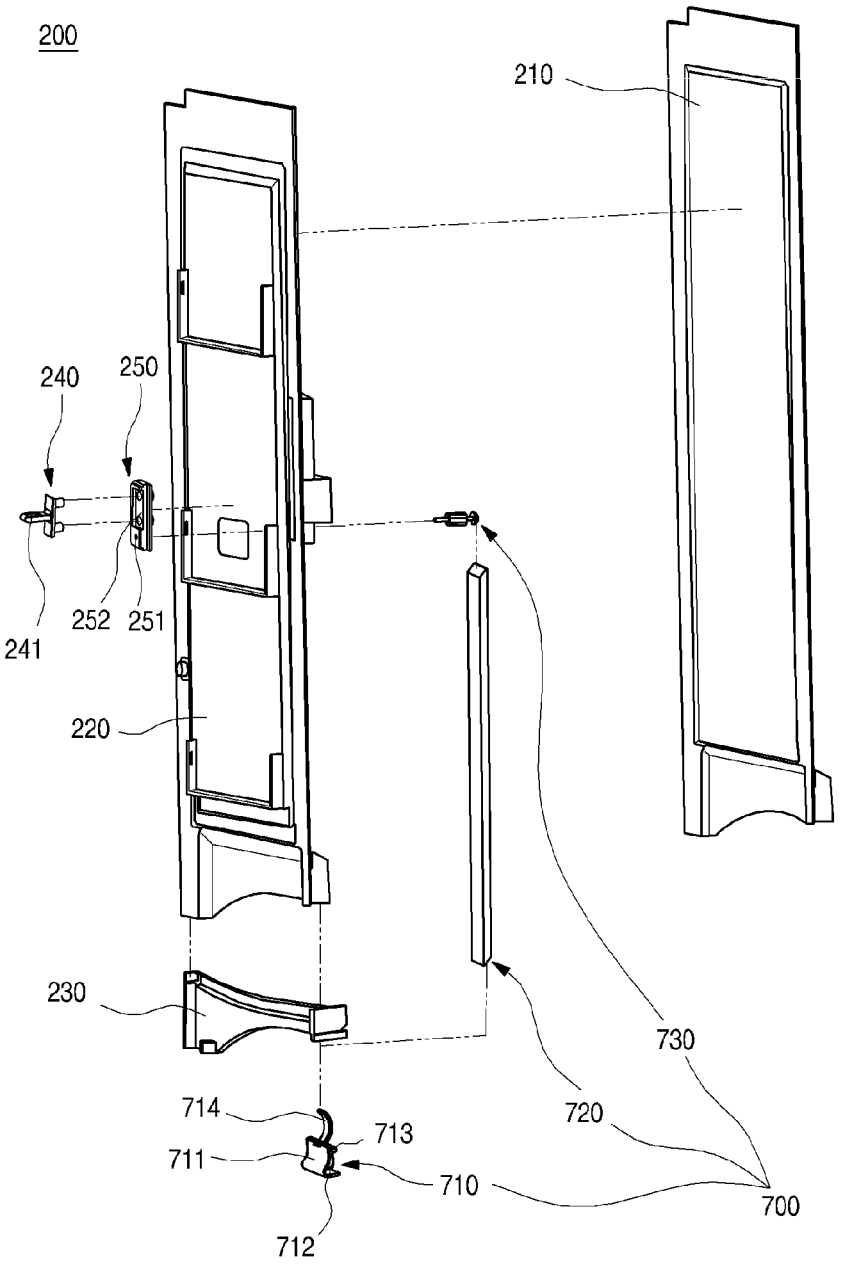
FIG. 15 is an exploded perspective view of the sub door.

Referring to FIGS. 13 to 15, the locking member 240 may be disposed on the back surface of the sub door 200. Also, the latch slot 141 may be defined in one side of the main door 100 that corresponds to the locking member 240.

When the sub door 200 is closed, the locking member 240 may be inserted into the latch slot 141. The locking member 240 may be restricted within the latch slot 141 in the state where the locking member 240 is inserted into the latch slot 141 to maintain the closed state of the sub door 200.

Also, a manipulation member 710 may be disposed on a lower end of the sub door 200. The manipulation member 710 may be configured to allow the user to manipulate an opening of the sub door 200. The manipulation member 710 may be disposed on a corner of a lower end of the sub door 200. Here, the manipulation member 710 may be disposed on a corner of the sub door 200 that is far away from the rotation shaft so that the sub door 200 easily rotates.

Also, the sub door 200 includes a door opening assembly 700 may include the manipulation member 710 to open or close the sub door 200. Hereinafter, a structure of the door opening assembly 700 will be described in more detail with reference to the accompanying drawings.

Figure 16:
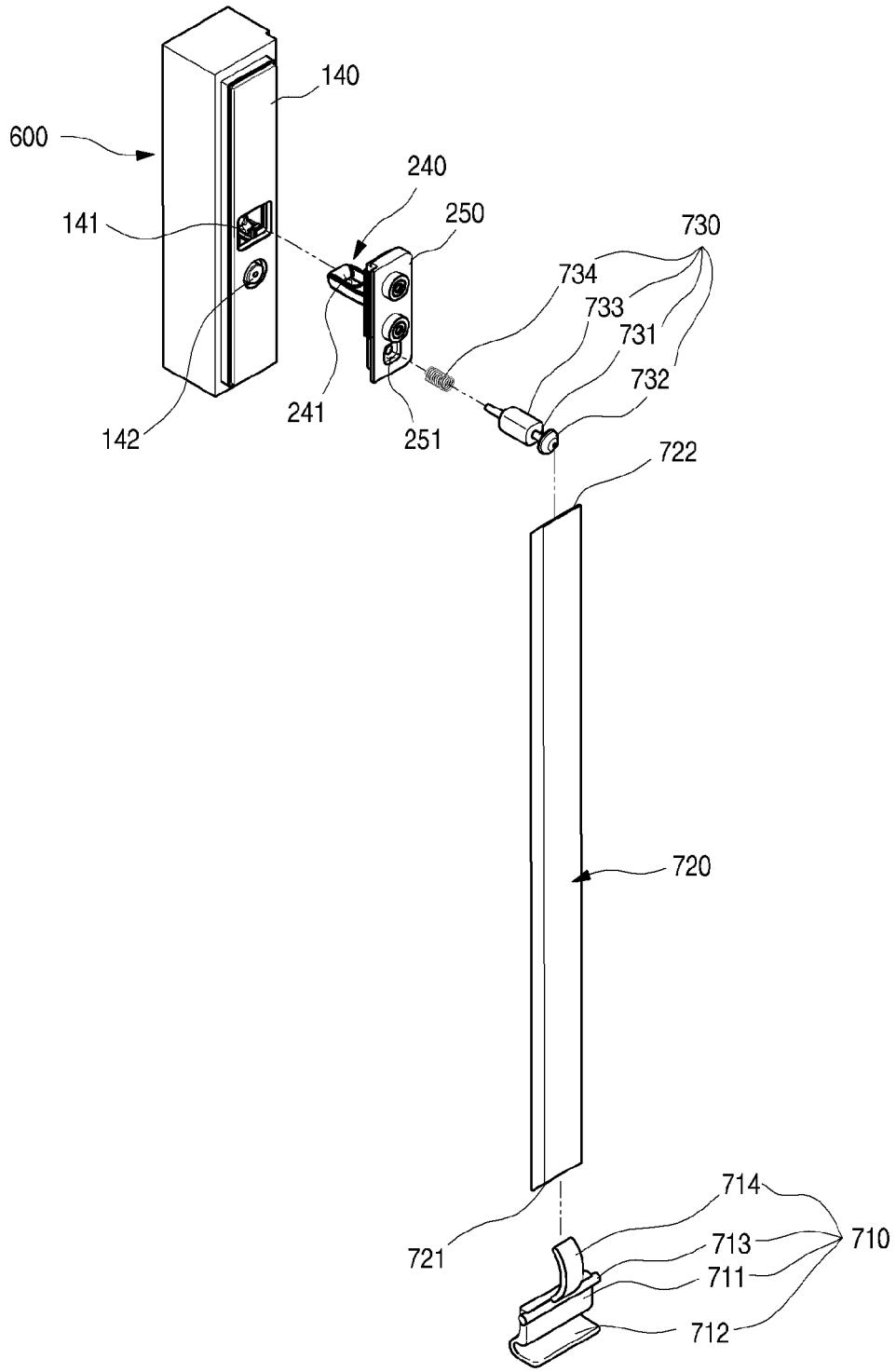
FIG. 16 is a perspective view of a door opening assembly and a locking unit according to the third implementation.

As illustrated in FIG. 16, a door opening assembly 700 is disposed inside the sub door 200. That is, the door opening assembly 700 is disposed between the outer case 210 defining an exterior of the sub door 200 and the door liner 220 defining the inside of the sub door 200. Here, the door opening assembly 700 may be mounted so that only a manipulation member 710 for manipulation is exposed to the outside.

Here, an insulation material may be filled into the sub door 200. The insulation material may not be filled into a region in which the door opening assembly 700 is disposed, or a separate insulation structure may be provided to surround the door opening assembly 700. Accordingly, by not injecting a foam solution in this region, the door opening assembly 700 may be operated smoothly.

The door opening assembly 700 may include a manipulation member 710 that is manipulated by the user, a push rod 730 selectively protruding backward from the inside of the sub door 200 to push the opening rod 640, and a connection member 720 connected to the manipulation member 710 so that the push rod 730 is operable.

In detail, the manipulation member 710 is disposed on a lower end of the sub door 200. The manipulation member 710 may be one component of the door opening assembly 700 to allow the push rod 730 to be operable. Also, the manipulation member 710 is disposed on a corner of a lower end of the manipulation member 710.

The manipulation member 710 may protrude to the outside in the state where the manipulation member 710 is disposed on the lower end of the sub door 200 so that the user is capable of manipulating the manipulation member 710. Here, only a portion of the manipulation member 710 that is manipulated by the user may be exposed to a grip part 33 disposed at a center of a refrigerating compartment door 30. That is, the exposed portion of the manipulation member 710 may be minimized when a user sees the refrigerator.

The manipulation member 710 may be mounted on the cap deco 230 defining the lower end of the sub door 200 and also rotates by the user's manipulation. Explaining the manipulation member 710 in more detail, the manipulation member 710 may include a body 711 mounted inside the sub door 200, a rotation shaft 713 disposed on each of both sides of the body 711, a push part 712 extending from a lower end of the body 711 and manipulated by the user, and an operational part 714 extending upward from an upper end of the body 711.

The push part 712 may be bent from a lower end of the body 711 and be exposed to a lower side of the sub door 200. The push part 712 may be spaced apart from a bottom surface of the sub door 200 and be bent in parallel to a bottom surface of the sub door 200. Thus, the user may push or rotate the push part 712 through the lower end of the sub door 200 to manipulate the manipulation member 710.

Also, in the state where the manipulation member 710 is mounted inside the sub door 200 or on the cap deco 230, the body, the rotation shaft 713, and the operational part 714 except for the push part 712 of the manipulation member 710 may be disposed inside the cap deco 230, and only the push part 712 may protrude downward from the cap deco 230. Here, a front end of the push part 712 is configured so that the user pushes the push part 712 to allow the manipulation member 710 to rotate in a state where the front end of the push part 712 is spaced apart from a lower end of the cap deco 230.

The operational part 714 extends upward from the upper end of the body 711 and has a predetermined curvature. The operational part 714 may have an upper end contact a lower end of the connection member 720. The upper end of the operational part 714 may push the lower end of the connection member 720 upward according to the manipulation of the push part 712 to vertically move the connection member 720.

For this, the upper end of the operational part 714 may have a slope. Thus, the slope may have the same inclination as the lower end of the connection member 720 so that the operational part 714 surface-contacts the lower end of the connection member 720.

The connection member 720 may have a long rod shape. The connection member 720 may have the lower end contacting the operational part 714 and the upper end contacting the push rod 730. Here, the connection member 720 may stably vertically move inside the sub door 200. For this, a separate guide, passage, or case for preventing the connection member 720 from horizontally moving may be provided.

The upper and lower ends of the connection member 720 may have slopes 721 and 722, respectively. The slopes 721 and 722 of the upper and lower ends may be in contact with the operational part 714 and the push rod 730, respectively. Thus, when the manipulation member 710 is manipulated, the push rod 730 may be manipulated through the connection member 720.

Also, the push rod 730 is disposed on the sub door 200. The push rod 730 is configured to control an operation of the locking unit 600. That is, the push rod 730 may be configured to push the opening rod 640, thereby releasing the restriction of the sub door 200 and opening the sub door 200.

In detail, the push rod 730 may be mounted on a mounting plate 250 disposed on a door liner 220 of the sub door 200. A push rod hole 251 through which the push rod 730 passes is defined in the mounting plate 250. A latch mounting part 252 on which the locking member 240 is mounted is disposed under the push rod hole 251.

The push rod 730 may include a rod part 731 extending by a predetermined length, a contact part 732 disposed on a rear end of the rod part 731 to contact the upper end of the connection member, and a rod case 733 through which the rod part 731 passes and in which a spring 734 is accommodated.

The rod case 733 is fixedly mounted on a back surface of the mounting plate 250, and the spring 734 is accommodated in the rod case 733. Also, an end of the rod part 731 may pass through the rod case 733 and be disposed in the push rod hole 251. Here, the contact part 732 is exposed to a rear side of the rod case 733.

Since the contact part 732 has a hemisphere shape that protrudes backward, the contact part 732 may contact the sloped upper end of the connection member 720 and easily move in the front/rear direction through the contact with the connection member 720.

Thus, when the connection member 720 moves upward, the slope 722 of the connection member 720 may push the contact part 732, and thus, the rod part 731 may move forward to allow a front end thereof to protrude forward from the door liner 220 through the push rod hole 251. Also, the spring 734 disposed inside the rod case 733 may be compressed as the rod part 731 moves forward.

The front end of the rod part 731 that protrudes through the push rod hole 251 may be disposed to push the front end of the opening rod 640. Thus, the restriction between the locking unit 600 and the locking member 240 may be released.

The locking member 240 may be mounted on the latch mounting part 252 of the mounting plate 250 to protrude backward from a rear end of the door liner 220. Also, a restriction part 241 that is opened to be coupled to the latch cam 620 of the locking unit 600 may be further disposed on the locking member 240. That is, the locking member 240 is inserted into the latch slot 141 in the state where the sub door is closed. Here, the sub door 200 may be maintained in the closed state due to the hooking and restriction with the rotating latch cam 620.

Figure 17:
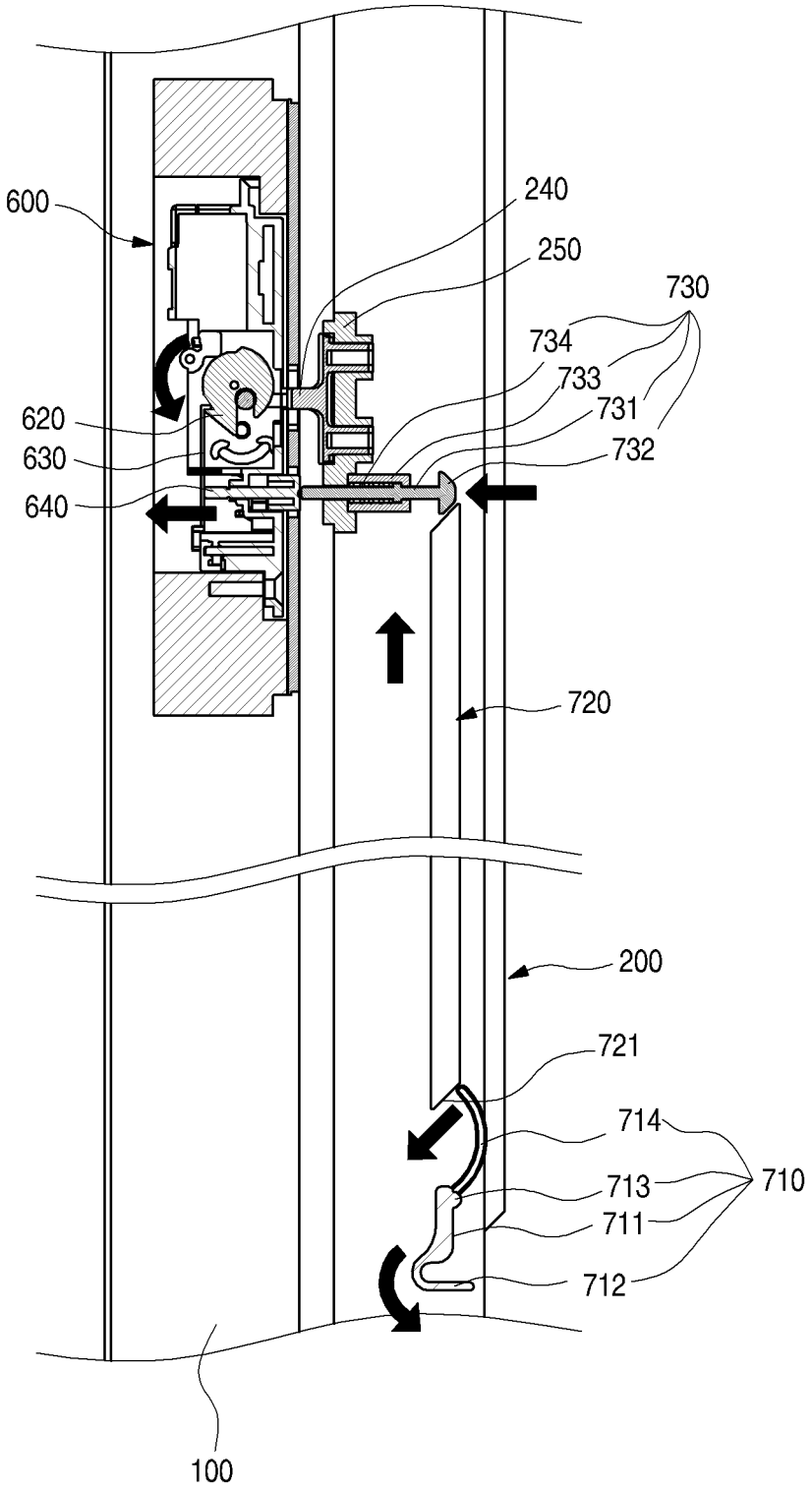
FIG. 17 is a view illustrating the door opening assembly in a state where the sub door is closed.

As illustrated in FIG. 17, in the state where the sub door 200 is closed, the back surface of the sub door 200 may be closely attached to the front surface of the main door 100. Here, the locking member 240 may be inserted into the latch slot 141 and then fixed in a state where the locking member 240 is hooked and restricted with the latch cam 620.

In detail, in the state where the sub door 200 is fully closed, the restriction part 241 of the locking member 240 may be inserted into the latch insertion part 621 of the latch cam 620 and then hooked and fixed. Thus, the locking member may be in the restricted state, and the sub door 200 may also be maintained in the closed state.

Here, the push rod 730 may be maintained in a state where an external force is not applied, and the spring 734 is not compressed. In this state, the push rod 730 may move backward, and the end of the push rod 730 may be disposed inside the push rod hole 251. Thus, the push rod 730 may not protrude, but be disposed inside the mounting plate 250.

Also, in the state where the contact part 732 contacts the upper end of the connection member 720, the lower end of the connection member 720 may be in contact with the operational part of the manipulation part 720. Thus, when the user push the push part, the push rod 730 may be immediately interlocked.

In detail, the manipulation member 710 may be in contact with the lower end of the connection member 720, and the push part 712 may be exposed to the outside through the lower end of the sub door 200. Here, the push part 712 may be pushed in a state where the push part 712 is spaced apart from the bottom surface of the sub door 200 to allow the manipulation member 710 to rotate.

In this state, if it is intended to open the sub door 200, the user may manipulate the manipulation member 710 to move the push rod 730 forward. Thus, the push rod 730 may push the opening rod 640 to release the restriction with the stopper 630, and the latch cam 620 may rotate to release the restriction with the locking member 240. As described above, when the restriction of the locking member 240 is released, the locking member 240 may be withdrawn from the latch slot 141 to open the sub door 200.

Figure 18:
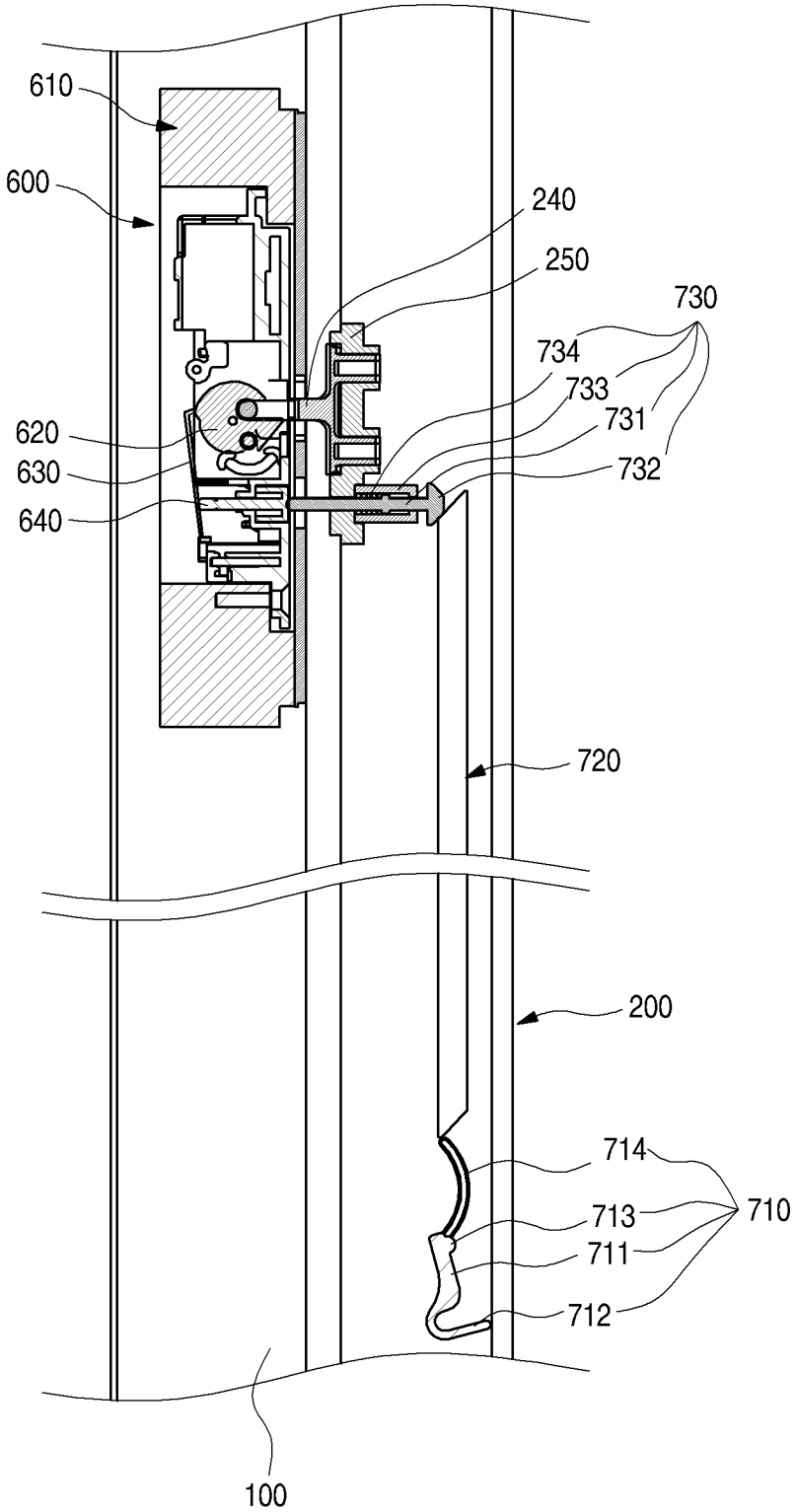
FIG. 18 is a view illustrating the door opening assembly in a state where the sub door is opened.

FIG. 18 is a view of a state of the door opening assembly in the state where the sub door is opened.

As illustrated in FIG. 18, to open the sub door 200, the user pushes the push part 712 of the manipulation member 710. When the push part 712 is pushed, the manipulation member 710 rotates about the rotation shaft 713 of the manipulation member 710, and thus the operational part 714 may rotate in a counterclockwise direction to push the lower end of the connection member 720 upward.

The connection member 720 may move upward by the operational part 714, and the slope 722 disposed on the upper end of the connection member 720 may push the contact part 732 of the push rod 730. Thus, the push rod 730 may smoothly move backward. As the push rod 730 moves backward, the spring 734 may be compressed.

As the push rod moves backward, the front end of the push rod 730 may pass through the push rod hole 251 to push the end of the opening rod 640. Thus, the opening rod 640 may be inserted, and the rear end of the opening rod 640 may push the stopper 630, thereby releasing the restriction between the stopper 630 and the latch cam 620.

When the restriction of the latch cam 620 is released, the latch cam 620 rotates by the elastic restoring force of the elastic member that forcibly rotates the latch cam 620. Thus, the latch insertion part 621 of the latch cam 620 may move forward to release the restriction of the locking member 240. Thus, the sub door 200 may freely rotate and be opened by the user.

Here, since the user pushes the manipulation member 710 disposed at a position that is away from the rotation shaft of the sub door 200 to manipulate the manipulation member 710, the user may rotate the sub door 200 while the user pushes the manipulation member 710 or grasps the corresponding portion after pushing the manipulation member 710.

Also, if the user separates his or hand from the push part 712 after the sub door 200 is opened, the connection member 720 moves downward by a self-weight thereof. Thus, the lower end of the connection member 720 may push the operational part 714, and the manipulation member 710 may return to its original position while rotating.

Also, since the external force applied to the spring 734 is removed, the push rod 730 moves backward by the elastic restoring force. Thus, the connection member 720 contacting the contact part 732 of the push rod 730 may move downward.

When the sub door 200 is closed in the state where each of the manipulation member 710 and the push rod 730 returns to its initial state, the front end of the locking member 240 may be inserted through the latch slot 141 and be accommodated into the latch insertion part 621 of the latch cam 620 to allow the latch cam 620 to rotate.

Also, the elastic member is compressed while the latch cam 620 rotates, and the restriction part 241 of the locking member 240 is inserted into the latch insertion part 621 and then is restricted to maintain the closed state of the sub door 200.

A refrigerator according to a fourth implementation includes an additional openable door on each of a refrigerating compartment door and a freezing compartment door. Also, a door opening assembly may be disposed on each of the additional doors.

The refrigerator according to the fourth implementation may have largely similar components as the foregoing implementations except for a structure of the door and a mounting position of the door opening assembly.

Figure 19:
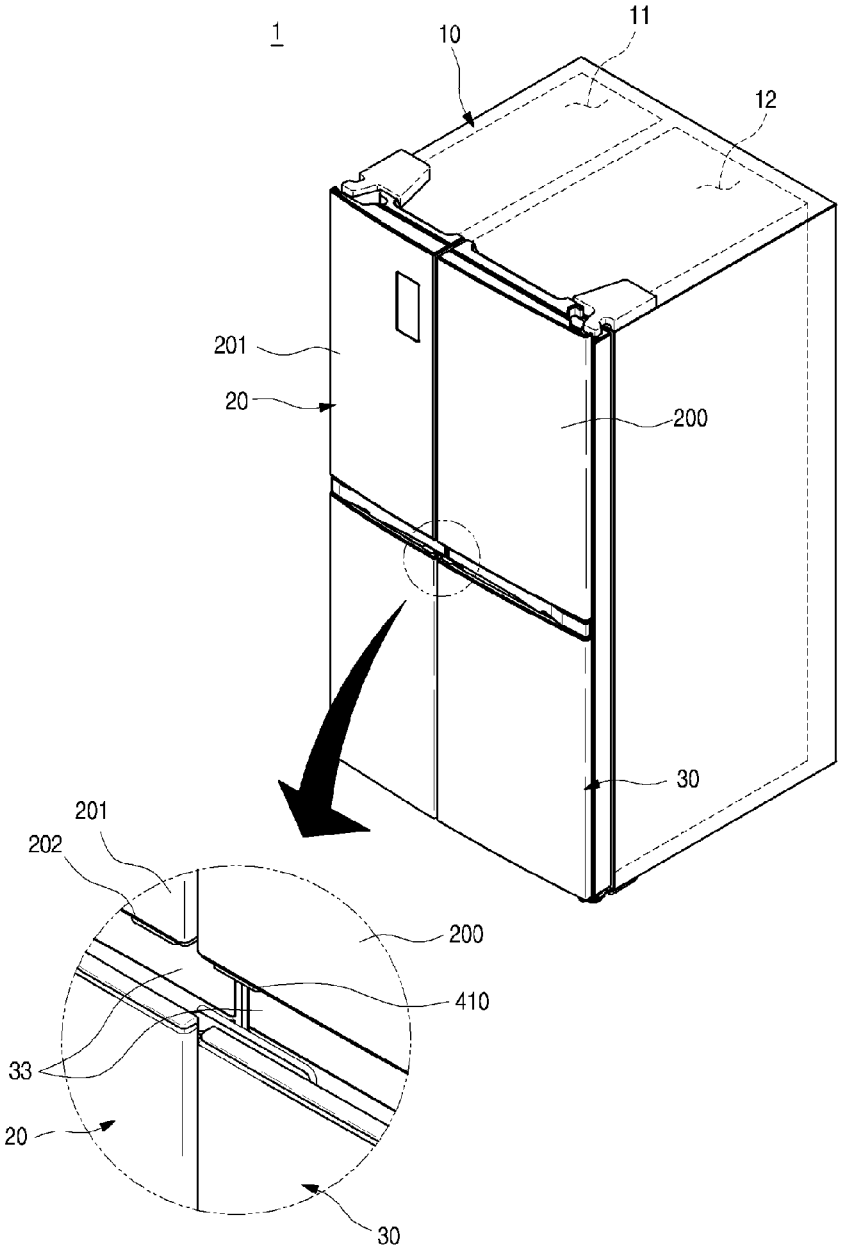
FIG. 19 is a perspective view illustrating an exterior of a refrigerator according to a fourth implementation.

Referring to FIG. 19, an opening that is defined by opening a portion of the front surface of each of the freezing compartment door 20 and the refrigerating compartment door 30 may be defined in each of the freezing compartment door 20 and the refrigerating compartment door 30, and thus foods accommodated in the accommodation device may be accessible through the opening. The accommodation device may be provided on each of the freezing compartment door 20 and the refrigerating compartment door 30 and may be disposed above the grip part 33. Also, the first sub door 200 and a second sub door 201 for opening or closing the opened front surfaces of the accommodation devices disposed on the freezing compartment door 20 and the refrigerating compartment door 30 may be provided on the freezing compartment door 20 and the refrigerating compartment door 30.

Each of the first and second sub doors 200 and 201 may have the same plane as the front surface of each of the freezing compartment door 20 and the refrigerating compartment door 30, which are disposed under the grip part 33. Also, the first and second sub doors 200 and 201 may have the same pattern and be formed of the same material. Since other structures except for the mounting position of the second sub door 201 may be equal to that of the sub door 200 according to the first implementation, their detailed descriptions will be omitted.

Also, a door opening assembly may be disposed on each of the first and second sub doors 200 and 201. The door opening assembly may have the same constitution as the door opening assembly 700 according to the first or second implementation except for a mounting position thereof, and thus its detailed description will be omitted.

In detail, manipulation members 410 and 202 of the door opening assembles that are disposed the first and second sub doors 200 and 201 may be disposed on lower ends of the first and second sub doors 200 and 201, respectively. Here, the manipulation members 410 and 202 may be disposed on corners that are adjacent to each other.

That is, the manipulation members 410 and 202 may be disposed on ends of the first and second sub doors 200 and 201 disposed at positions that are far away from rotation shafts of the first and second sub doors 200 and 201, respectively. Thus, the manipulation members 410 and 202 may be easily manipulated, and the first and second sub doors 200 and 201 may rotate at the same time.

Also, since the manipulation members 410 and 202 are disposed adjacent to each other, the user may more easily manipulate the first and second sub doors 200 and 201.

A refrigerator according to a fifth implementation includes an additional openable door on at least one of a refrigerating compartment door and a freezing compartment door. Also, a door opening assembly may be disposed on the additional door.

Figure 20:
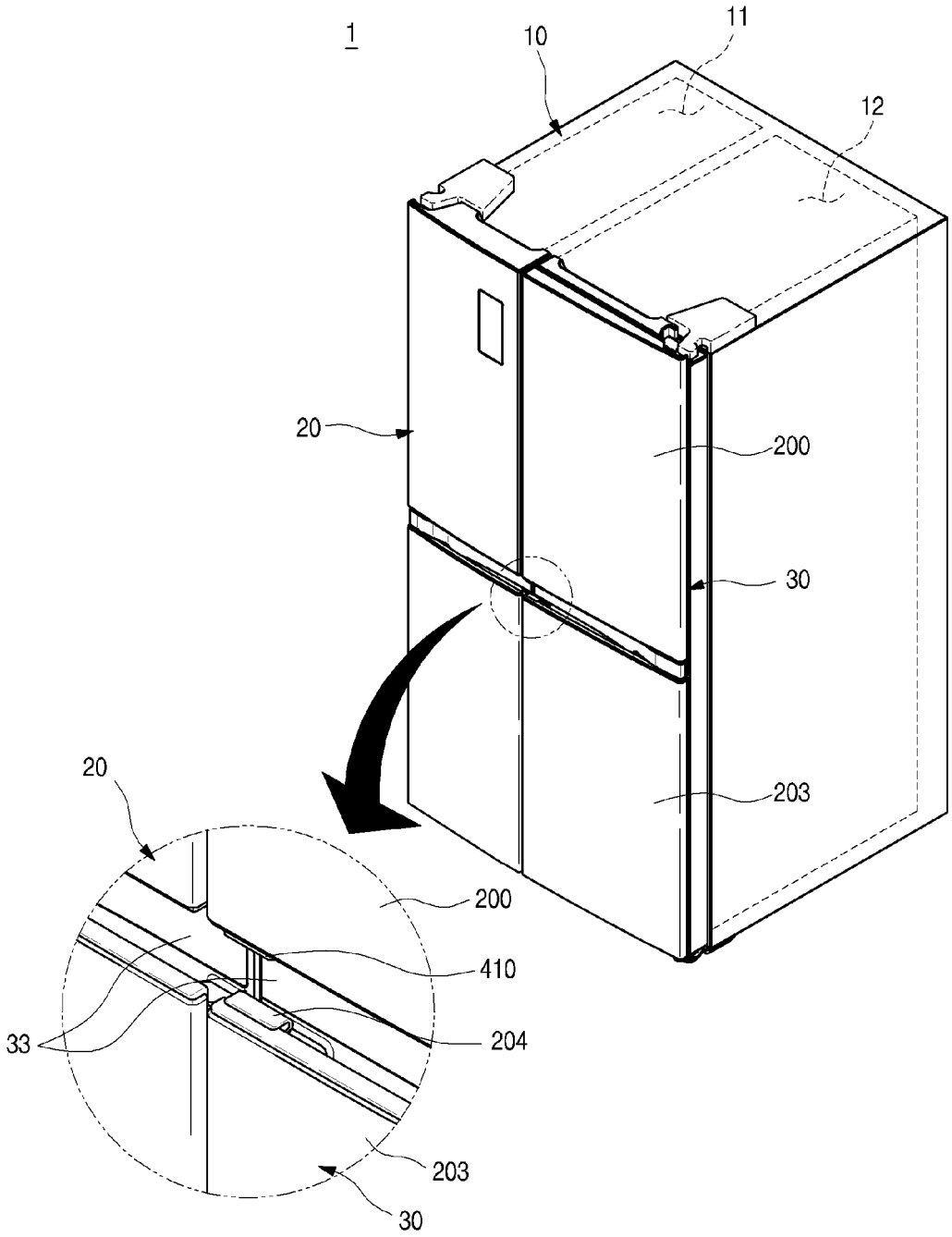
FIG. 20 is a perspective view illustrating an exterior of a refrigerator according to a fifth implementation.
Figure 21:
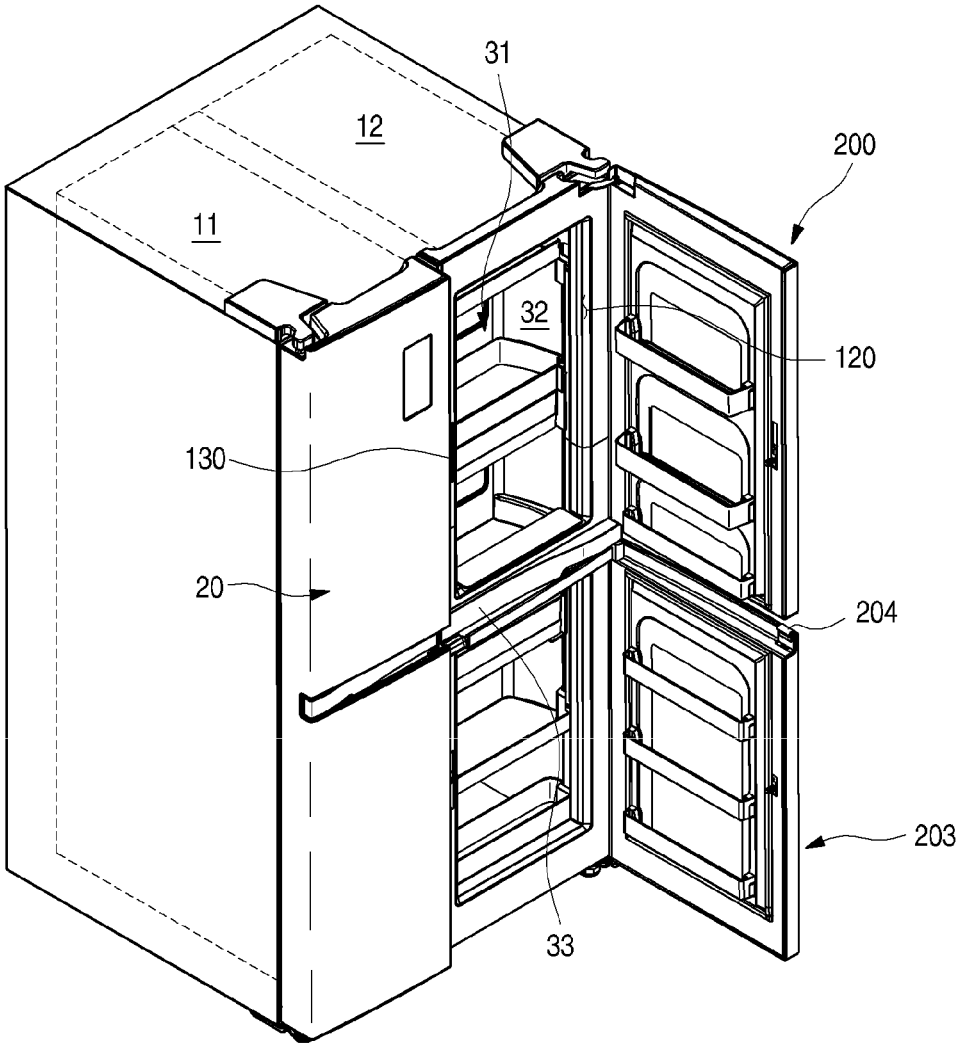
FIG. 21 is a perspective view of the refrigerator with a sub door opened.

For example, referring to FIG. 20, the opened accommodation device 31 may be disposed in a front surface of the refrigerating compartment door 30. The accommodation device 31 may be disposed on each of upper and lower sides of the grip part 33. Also, a first sub door 200 and a third sub door 203 for opening or closing opened front surfaces of storage compartments 32 of the accommodation device disposed on the refrigerating compartment door 30 may be provided on the refrigerating compartment door 30.

Front surfaces of the first and third sub doors 200 and 203 may be disposed on the same plane and have the same plane as a front surface of the freezing compartment door 20. Also, the first and third sub doors 200 and 203 may have the same pattern and be foil led of the same material. Since the first and third sub doors 200 and 203 have the same structure as the sub door 200 according to the first implementation, their detailed descriptions will be omitted.

Also, a door opening assembly may be disposed on each of the first and third sub doors 200 and 203. The door opening assembly may have largely similar structure as the door opening assembly according to the first or second implementation except for a mounting position thereof, and thus its detailed description will be omitted.

In detail, manipulation members 410 and 204 of the door opening assembles that are disposed the first and third sub doors 200 and 203 may be disposed on upper ends of the first and third sub doors 200 and 203, respectively. Here, the manipulation members 410 and 204 may be disposed on facing corners that are adjacent each other.

That is, the manipulation members 410 and 204 may be disposed on lower and upper ends of the first and third sub doors 200 and 203 disposed at positions that are far away from rotation shafts of the first and third sub doors 200 and 203, respectively. Thus, the manipulation members 410 and 204 may be easily manipulated, and the first and third sub doors 200 and 203 may rotate at the same time.

Also, since the manipulation members 410 and 204 are disposed adjacent to each other, the user may more easily manipulate the first and third sub doors 200 and 203.

A pair of additional sub doors may be openably disposed on the refrigerating compartment door and the freezing compartment door according to the combination of the third and fourth implementations, respectively. Also, a door opening assembly may be disposed on each of the additional doors. Here, the door opening assembly may be disposed on an end of each of the doors that are disposed on an area on which the grip part is disposed. Also, the door opening assembly may be disposed at a position that is far away from a rotation shaft of each of the doors.

According to the proposed implementations, since the locking member is disposed at the position at which the door is easily fixed, and the manipulation member is disposed on the end at which the user's manipulation is easy, and the design of the front surface is not deteriorated in the door opening assembly, the opening/closing performance of the door may be maintained while maintaining the more elegant exterior of the door.

Also, the manipulation member may be disposed on a side facing the rotation shaft of the door so that the opening/closing and the rotation of the door are performed at the same position. Thus, the door may be more easily opened or closed.

In addition, since the manipulation member is disposed on the handle, the user's manipulation may be easier, and the manipulation member may not be exposed to the front surface of the door to realize the more elegant exterior of the door.

Although implementations have been described with reference to a number of illustrations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a first storage compartment;

a main door rotatably mounted on the cabinet to open or close the first storage compartment, and having an opening;

a grip part that is horizontally formed at the main door to serve as a handle for opening or closing the main door;

an accommodation device that is accessible through the opening of the main door, the accommodation device defining a second storage compartment in a back surface of the main door;

a sub door opening or closing the opening of the main door; and a door opening assembly with which one side of a back surface of the sub door and one side of the main door are selectively restricted, the door opening assembly being configured to selectively restrict the sub door and the main door at a side edge of the sub door, wherein the door opening assembly comprises:

a locking member at least a portion of which protrudes from the back surface of the sub door;

a manipulation member disposed on a corner of a lower end of the sub door; and a connection member disposed inside the sub door to connect the locking member and the manipulation member;

wherein at least a portion of the manipulation member is exposed to the grip part to be manipulated by a user; and wherein the connection member is moved in a direction from the manipulation member toward the locking member by a manipulation of the manipulation member to selectively release a restriction state between the locking member and the main door.

2. The refrigerator of claim 1, wherein the grip part has a shape that is recessed inward and downward to allow the user to easily grasp.

3. The refrigerator of claim 1, wherein a lower end of the sub door is adjacent to an upper end of the grip part.

4. The refrigerator of claim 1, wherein the manipulation member comprises:

a rotational part rotatably mounted inside the sub door by a rotation shaft;

a push part extending from a lower portion of the rotational part and exposed outside to be pushed by the user; and a support part extending from an upper part of the rotational part to be disposed above the push part.

5. The refrigerator of claim 4, wherein a lower end of the connection member is shaft-coupled to an end of the support part.

6. The refrigerator of claim 5, wherein when the push part is pushed up by the user, the manipulation member is rotated about the rotation part, and the support part moves upward to move up the connection member.

7. The refrigerator of claim 1, wherein the locking member includes:

a shaft coupling part extending horizontally in a widthwise direction of the sub door and having shafts at both ends; and a body extending horizontally from the shaft coupling part in a front-to-rear direction of the sub door, an end of the body protruding from the back surface of the sub door.

8. The refrigerator of claim 7, further comprising:

an accommodation part formed in a front surface of the main door at a position corresponding to the locking member when the sub door is in a closed position; and a hook part protruding in the accommodation part and having a projection shape, wherein the end of the body is inserted in the accommodation part when the sub door in the closed position.

9. The refrigerator of claim 8, wherein a restriction part is formed in the end of the body; and a restriction roller disposed at a front end of the restriction part and selectively hooked to the hook part.

10. The refrigerator of claim 7, wherein the locking member further includes:

an elastic member support part formed on the shaft coupling part; and an elastic member coupled to the elastic member support part.

11. The refrigerator of claim 7, further comprising a guide member installed inside the sub door, wherein the guide member comprises:

a locking member mounting part on which the locking member is received; and a connection member guide part in which the connection member is received, wherein an upper end of the connection member guide part communicates with the locking member mounting part, such that the upper end of the connection member guide part is in contact with a lower surface of the body of the locking member.

12. The refrigerator of claim 1, wherein the opening of the main door is configured to extend from the grip part up to a position adjacent to an upper end of the main door.

* * * * *